US010899152B2

(12) United States Patent
Chiles et al.

(10) Patent No.: US 10,899,152 B2
(45) Date of Patent: Jan. 26, 2021

(54) SYSTEMS AND METHODS FOR PROVIDING AN INK PAD

(71) Applicant: Cabin Creek, LLC, Pleasant Grove, UT (US)

(72) Inventors: Ross Chiles, Taipei (TW); Tai-Yu Han, Taipei (TW); Jamie Hascall, Salt Lake City, UT (US)

(73) Assignee: Cabin Creek, LLC, Pleasant Grove, UT (US)

( * ) Notice: Subject to any disclaimer, the term of this patent is extended or adjusted under 35 U.S.C. 154(b) by 0 days.

(21) Appl. No.: 15/629,507

(22) Filed: Jun. 21, 2017

(65) Prior Publication Data

US 2017/0368857 A1 Dec. 28, 2017

Related U.S. Application Data

(60) Provisional application No. 62/354,085, filed on Jun. 23, 2016.

(51) Int. Cl.

| | |
|---|---|
| ***B41K 1/54*** | (2006.01) |
| ***B41K 1/38*** | (2006.01) |
| ***B41K 1/36*** | (2006.01) |
| ***B41K 1/34*** | (2006.01) |
| *B41K 1/00* | (2006.01) |

(52) U.S. Cl.

CPC ..... *B41K 1/54* (2013.01); *B41K 1/34* (2013.01); *B41K 1/36* (2013.01); *B41K 1/38* (2013.01); *B41K 1/00* (2013.01)

(58) Field of Classification Search

CPC ... B41K 1/00; B41K 1/34; B41K 1/36; B41K 1/54; B41K 1/38; A45D 33/006; A45D 40/24

See application file for complete search history.

(56) References Cited

U.S. PATENT DOCUMENTS

| | | | | |
|---|---|---|---|---|
| 1,598,538 A * | 8/1926 | Mann | B41K 1/54 | 118/269 |
| 3,077,282 A * | 2/1963 | Eggers | E05D 1/06 | 16/224 |
| 5,135,012 A * | 8/1992 | Kamen | A45C 13/02 | 132/294 |
| 5,505,130 A * | 4/1996 | Winston | B41K 1/54 | 101/327 |
| 5,601,867 A * | 2/1997 | Riedl | A61B 5/1172 | 118/31.5 |

(Continued)

*Primary Examiner* — Matthew G Marini
*Assistant Examiner* — Marissa Ferguson-Samreth
(74) *Attorney, Agent, or Firm* — David B. Tingey; Bryant J. Keller; Kirton McConkie

(57) ABSTRACT

While the described ink pad can include any suitable component, in some cases it includes a lid, a base, and an absorbent material. Additionally, in some cases, the lid and the base define a cavity that houses the absorbent material and the lid and the base each comprise one or more magnets and/or magnetic materials that are configured to magnetically couple with each other to releasably couple the lid and base together. In some instances, the ink pad further includes one or more seals that are configured to extend between the base and lid to limit air movement into the cavity when the lid and base are coupled together in a closed position. Additional implementations are described herein.

20 Claims, 21 Drawing Sheets

(56) References Cited

U.S. PATENT DOCUMENTS 5,842,486 A * 12/1998 Davis ..... A45C 13/008 132/295
6,725,801 B1 * 4/2004 Carrington ..... A61B 5/1172 118/31.5
6,725,802 B1 * 4/2004 Carrington ..... B41K 1/54 118/264
6,831,541 B1 * 12/2004 Seidler ..... A45D 33/006 206/818
7,055,216 B2 * 6/2006 Seidler ..... A45D 33/20 16/320
7,163,152 B2 * 1/2007 Osborn ..... A45C 11/182 235/486
7,246,556 B1 * 7/2007 Stoneberg ..... B41K 1/54 101/333
7,467,440 B2 * 12/2008 Seidler ..... B65D 51/04 16/320
8,316,765 B2 * 11/2012 Blanks ..... G09F 3/205 101/35
8,893,955 B2 * 11/2014 Clark ..... B65D 5/0085 229/120.09
9,237,791 B2 * 1/2016 Hirst ..... A45D 33/006
2005/0193407 A1 * 9/2005 Lessard ..... G11B 23/0014 720/728
2007/0131240 A1 * 6/2007 Prague ..... A45D 33/22 132/294
2010/0024271 A1 * 2/2010 Seidler ..... A47F 7/147 40/711
2010/0031835 A1 * 2/2010 Faber ..... B41K 1/54 101/333
2014/0043741 A1 * 2/2014 Smith ..... G06F 1/16 361/679.3
2014/0083997 A1 * 3/2014 Chen ..... A45C 11/00 220/4.02
2014/0184904 A1 * 7/2014 Lam ..... G06F 1/1616 348/375
2014/0284225 A1 * 9/2014 Davis ..... B44D 3/02 206/1.8
2016/0088920 A1 * 3/2016 LaHood, Sr. ..... A45D 33/006 264/255
2016/0183660 A1 * 6/2016 Kim ..... A45D 40/22 53/431
2019/0025889 A1 * 1/2019 Szeto ..... G06F 3/0346
2019/0374004 A1 * 12/2019 Martins ..... A45D 33/003

* cited by examiner

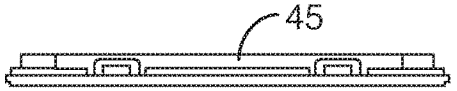
FIG. 6F
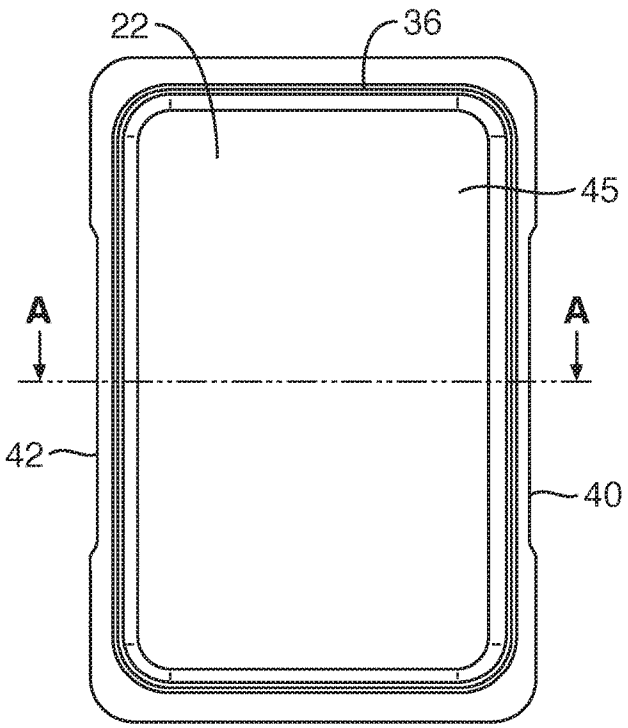
FIG. 6G
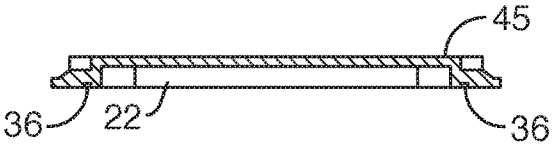
FIG. 6H
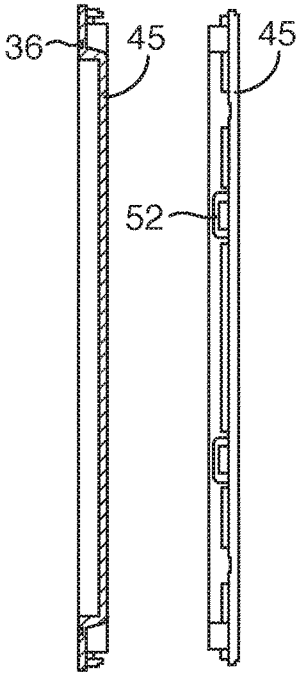
FIG. 6E
FIG. 6D
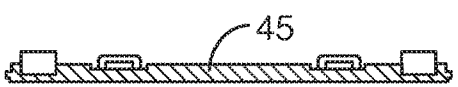
FIG. 6C
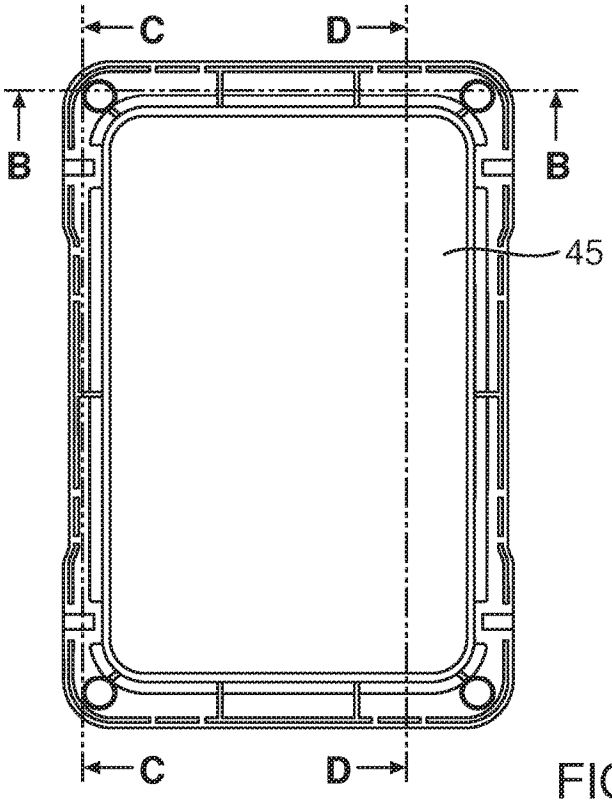
FIG. 6A
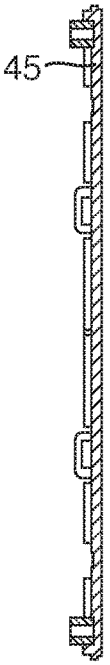
FIG. 6B

SYSTEMS AND METHODS FOR PROVIDING AN INK PAD

CROSS-REFERENCE TO RELATED APPLICATION

This application claims priority to U.S. Provisional Application Ser. No. 62/354,085, filed Jun. 23, 2016, and entitled SYSTEMS AND METHODS FOR PROVIDING AN INK PAD, the entire disclosure of which is hereby incorporated by reference.

BACKGROUND OF THE INVENTION

Field of the Invention

The present invention relates to ink pads. In particular, the present invention relates to systems and methods for providing an ink pad that is easily opened and sealed shut. In some implementations, the described ink pad comprises a lid and a base that are configured to couple with each other via one or more magnets and/or other coupling mechanisms.

Background and Related Art

Stamp pads generally comprise a quantity of ink that can be applied to a first surface (such as a stamp, fingertip, and/or any other suitable surface) by contacting the first surface with a portion of the stamp pad that comprises the ink. Once ink has been applied to the first surface, the first surface can then be pressed against a second surface such that a portion of the ink transfers from the first surface to the second surface. In this regard, stamp pads can be useful in a wide variety of applications in which ink is to be transferred from one surface with a particular pattern a stamp) to a second surface such that the pattern from the first surface is transferred to the second surface. Some non-limiting examples of stamp pad uses include creating stamped designs, date stamping, capturing fingerprints, and a wide variety of other uses that include applying ink to a desired surface.

While conventional stamp pads may be useful for containing and storing ink, such pads are not necessarily without their shortcomings. Indeed, some such pads can be relatively difficult to open, can be relatively difficult to close, can function in a non-intuitive manner, can allow the ink to dry out relatively rapidly, can readily allow ink to spread undesirably from the stamp pad to cause unwanted messes, and can otherwise be difficult to use.

Thus, while techniques currently exist that are used to provide stamp pads, challenges still exist, including those listed above. Accordingly, it would be an improvement in the art to augment or even replace current techniques with other techniques.

SUMMARY OF THE INVENTION

The present invention relates to ink pads. In particular, the present invention relates to systems and methods for providing an ink pad that is easily opened and sealed shut. In some implementations, the described ink pad comprises a lid and a base that are configured to couple with each other via one or more magnets and/or other coupling mechanisms.

The described ink pad (or pigment container) can comprise any suitable component or characteristic that allows it to contain and store a pigment (or ink) in a manner that a stamp, fingertip, and/or other transfer substrate is able to receive pigment from the pad and to deposit such pigment on another desired substrate. In some implementations, however, the ink pad comprises one or more lids, bases, absorbent materials, coupling mechanisms, seals, and/or gripping surfaces.

In accordance with some implementations, the pad, ink pad, and/or pigment pad (where such terms may be used interchangeably herein) has: a lid having a first magnetic coupler; a base having a second magnetic coupler; and an absorbent material that is configured to receive and store an amount of pigment, ink, and/or another suitable material. Additionally, in some such implementations, the lid and the base are configured to couple together in a face to face configuration so as to define a cavity that houses the absorbent material, and the first magnetic coupler and the second magnetic coupler are configured to magnetically couple with each other to magnetically and releasably couple the lid and the base together in the face to face configuration.

In accordance with some other implementations, the described ink pad includes: a lid defining a first recess and comprising a first magnetic coupler; a base defining a second recess and comprising a second magnetic coupler; an absorbent material comprising an ink (or other pigment); and a seal that is configured to be disposed between a face of the lid and a face of the base when the lid and the base are coupled together in a face to face configuration. In some such implementations, the first and second magnetic couplers are configured to magnetically and releasably couple the lid and the base together in the face to face configuration such that the first and second recesses form a cavity that houses the absorbent material.

In still other implementations, the ink pad includes: a lid defining a first recess and further comprising a first and a second magnetic coupler; a base defining a second recess and further comprising a third and a fourth magnetic coupler; an absorbent material comprising an ink (or other pigment), the absorbent material being coupled to, and disposed in, at least one of the first recess and the second recess; and a seal that is configured to be disposed between a face of the lid and a face of the base when the ink pad is in a closed position. Moreover, in some such implementations, the lid and base are configured to magnetically couple together such that the first and second recesses define a cavity that houses the absorbent material when the ink pad is in a closed position. Furthermore, in some implementations, the first and the third magnetic couplers are configured to magnetically and releasably couple with each other to magnetically and releasably couple the lid and base together at least one of face to face and back to back, and the second and fourth magnetic couplers are configured to magnetically and releasably couple with each other to magnetically and releasably couple a perimeter of the lid with a perimeter of the base when the ink pad is in an opened position.

While the described ink pad can be particularly useful in the area of containing and/or storing ink or another pigment for application to another surface via a die, block, seal, stamp, fingertip, and/or other transfer substrate, the described ink pad can be used to contain and store any other suitable material or materials, including, without limitation, one or more paints, pigments, dyes, pigment refills, inkless printing solutions (e.g., for fingerprinting and/or any other suitable purpose), balms, lotions, moisturizers, cosmetics, makeups, foundations (e.g., facial or otherwise), chalks, mirrors, combs, brushes, applicators, pictures, and/or other suitable materials and/or objects.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only representative embodiments of the present invention and are not, therefore, to be considered as limiting the scope of the invention, the present invention will be described and explained with additional specificity and detail through the use of the accompanying drawings in which:

FIG. 6A illustrates a back side view of an interior component of the lid or the base of the ink pad in accordance with a representative embodiment;

FIG. 6B illustrates a cross-sectional view of the interior component of FIG. 6A, taken along line C-C;

FIG. 6C illustrates a cross-sectional view of the interior component of FIG. 6A, taken along line B-B;

FIG. 6D illustrates a cross-sectional view of the interior component of FIG. 6A, taken along line D-D;

FIG. 6E illustrates a side view of the interior component of FIG. 6A;

FIG. 6F illustrates an end view of the interior component of FIG. 6A;

FIG. 6G illustrates a front side or face view of the face of the interior component of FIG. 6A;

FIG. 6H illustrates a cross-sectional view of the interior component illustrated in FIG. 6G and taken along line A-A;

DETAILED DESCRIPTION OF THE INVENTION

Figure 1:
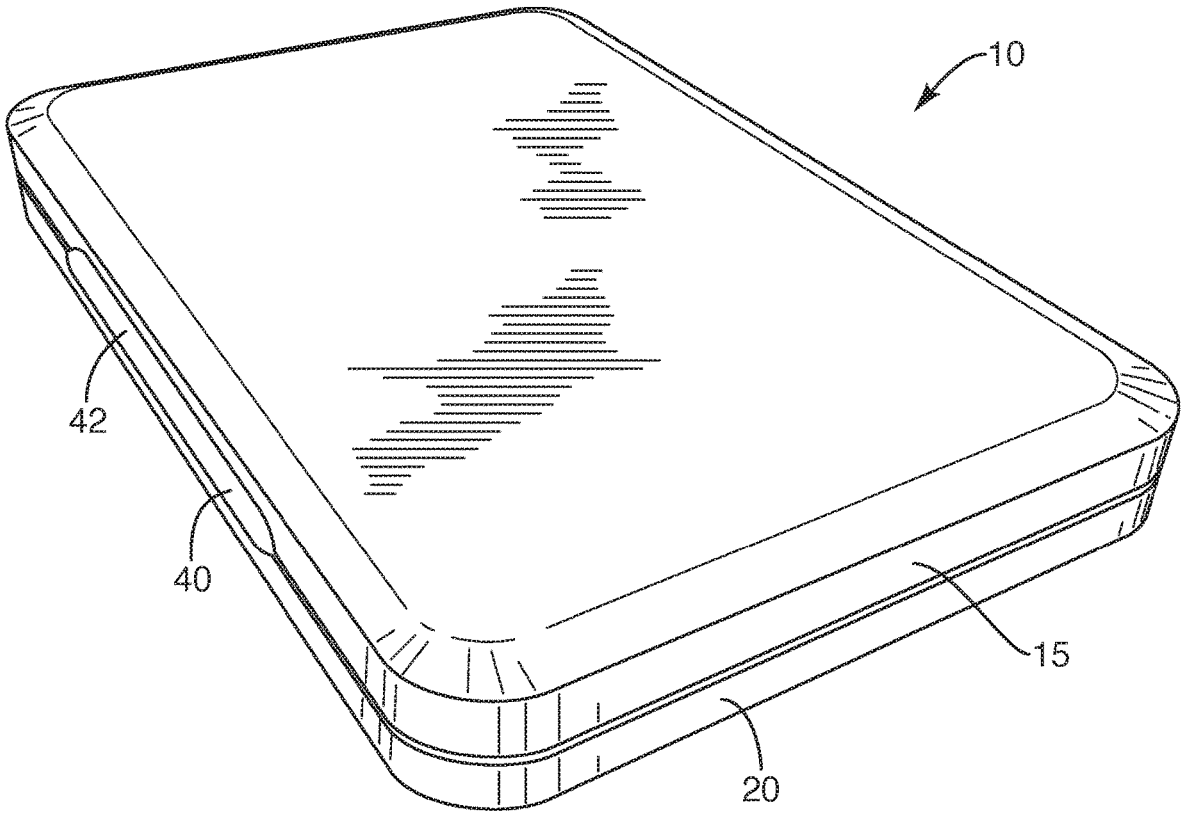
FIG. 1 illustrates a perspective view of a representative embodiment of an ink pad in a closed position.

The present invention relates to ink pads. In particular, the present invention relates to systems and methods for providing an ink pad that is easily opened and sealed shut. In some implementations, the described ink pad comprises a lid and a base that are configured to couple with each other via one or more magnets and/or other coupling mechanisms.

In general, the described systems and methods relate to an ink pad that is configured to contain and store one or more materials, such as one or more inks, paints, pigments, dyes, coloring agents, pigment refills, balms, lotions, moisturizers, cosmetics, makeups, foundations (e.g., facial or otherwise), chalks, mirrors, combs, brushes, applicators, pictures, writing utensils, and/or other suitable materials and/or objects. In some embodiments, however, the described ink pad comprises one or more pigments or inks, which can include, but are not limited to, one or more dye inks, inks, dyes, pigments, coloring agents, water-based dye inks, distress inks, waterproof dye inks, pigment inks, graphite inks, semi-inkless printing/stamp solutions, inkless printing/stamp solutions, solutions that cause a substrate (e.g., paper and/or any other suitable substrate) to change color in places that are contacted by such solutions, hybrid inks, solvent inks, chalk inks, watermark inks, resist inks, sticky inks, specialty inks, permanent inks, opaque inks, translucent inks, invisible inks, embossing inks, alcohol inks, reflective inks, glow in the dark inks, and/or other suitable materials comprising one or more pigments, dyes, coloring agents, and/or other inks that are configured to be absorbed into (or otherwise releasably retained at) an absorbent material in the ink pad, and then to be transferred from the absorbent material to another substrate by a stamp and/or another transfer substrate. In this regard, the terms ink, transferable pigment, and pigment may be used to refer to any of the foregoing materials.

While the described ink pad can comprise any suitable component or characteristic that allows it function as intended, FIGS. 1-4 show some representative embodiments in which the ink pad 10 comprises one or more lids 15, bases 20, coupling mechanisms 25, absorbent materials 30, seals 35, and/or gripping surfaces 40.

Figure 2:
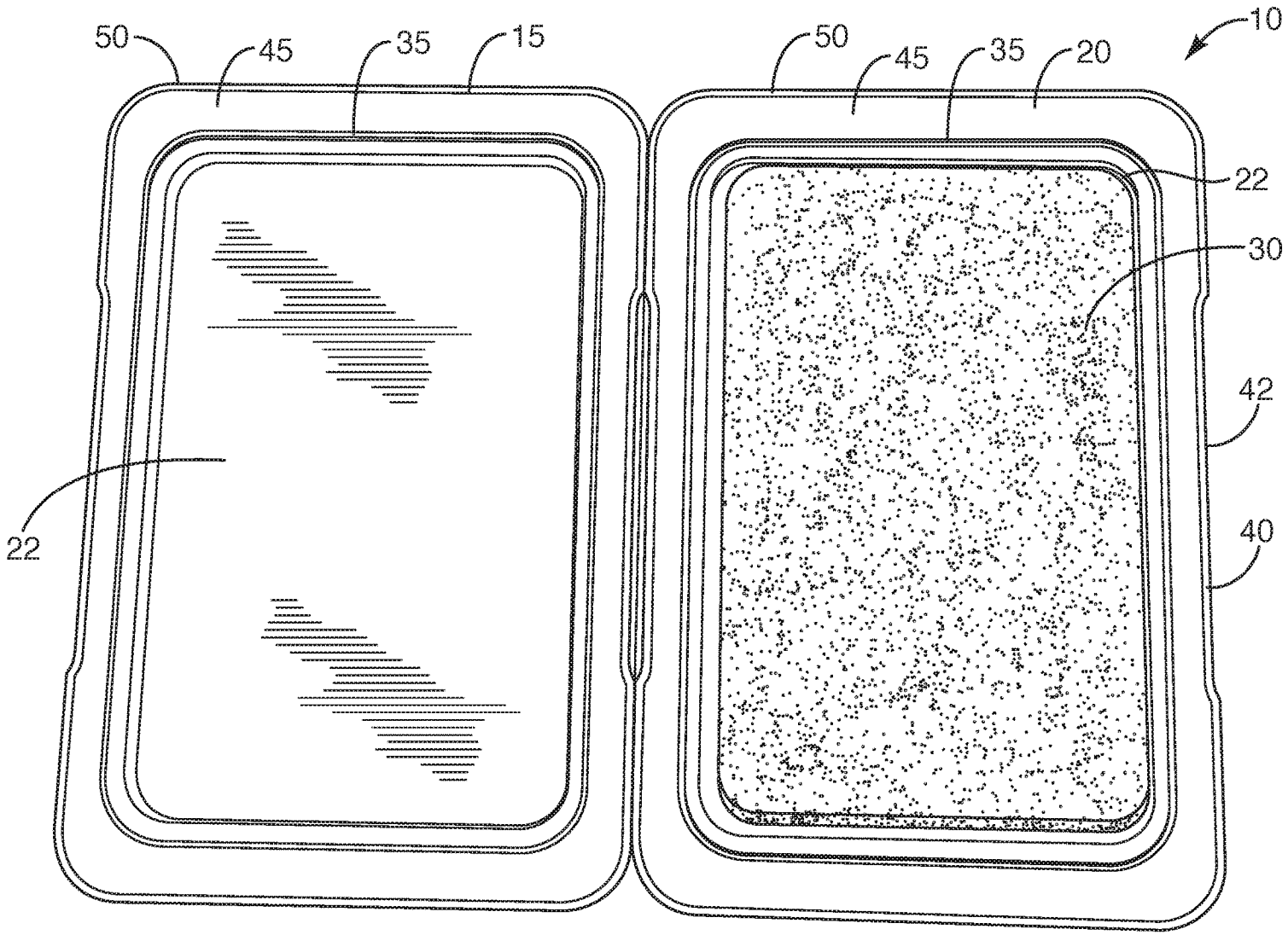
FIG. 2 illustrates a plan view of the ink pad in an open configuration, showing a face of a lid and a face of a base, in accordance with a representative embodiment.
Figure 3:
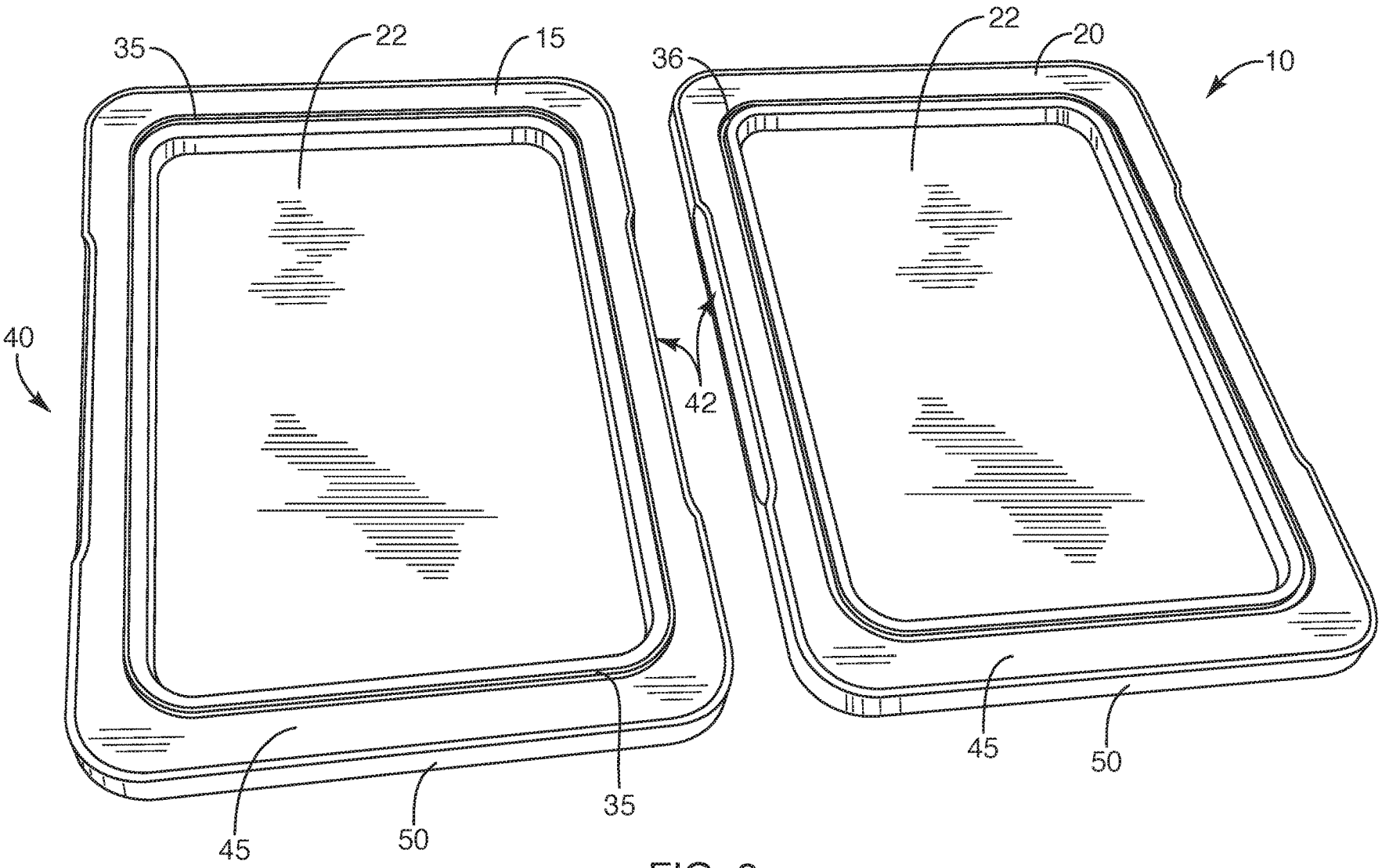
FIG. 3 illustrates a perspective view of the ink pad in an open configuration, showing the face of the lid and the base, in accordance with a representative embodiment.

With respect to the lid 15 and base 20, the lid and base can each comprise any suitable component or characteristic that allows them to couple together to form a cavity in which the absorbent material 30 and/or any other suitable material (e.g., ink) is stored. In some embodiments, at least one of the lid and the base are configured to hold the absorbent material. In this regard, the lid and/or base can comprise a one or more recesses, flat surfaces, and/or other contact surfaces on which the absorbent material is configured to be placed. By way of illustration, FIGS. 2-3 show some embodiments in which a face of the lid 15 and the face of base 20 each comprise a recess 22 that is configured to receive the absorbent material 30. In some other embodiments, the lid or the base comprises a recess that is configured to receive the absorbent material. Indeed, in some such embodiments in which the lid comprises a recess and the absorbent material is disposed in the lid, when the ink pad 10 is in a closed position and the ink pad is positioned such that the lid comprising the absorbent material is facing down, gravity pulls the ink to the surface of the absorbent material 30, helping to ensure the ink is readily usable.

While in some embodiments, one of the lid 15 or the base 20 individually defines the complete depth of the cavity or recess 22 (with the other comprising a substantially flat internal or face or surface that is configured to cap the cavity), in some other embodiments, each of the lid and the base define a portion of the cavity, or in other words, each of the lid and the base comprise a recess 22 on an internal surface. While, in some embodiments, such recesses are more or less pronounced in either the base or the lid, in other embodiments (e.g., as shown in FIG. 3), the recesses 22 extend approximately to the same depth within an inner surface 24 of a face of the lid 15 and a face of the base 20.

Figure 4:
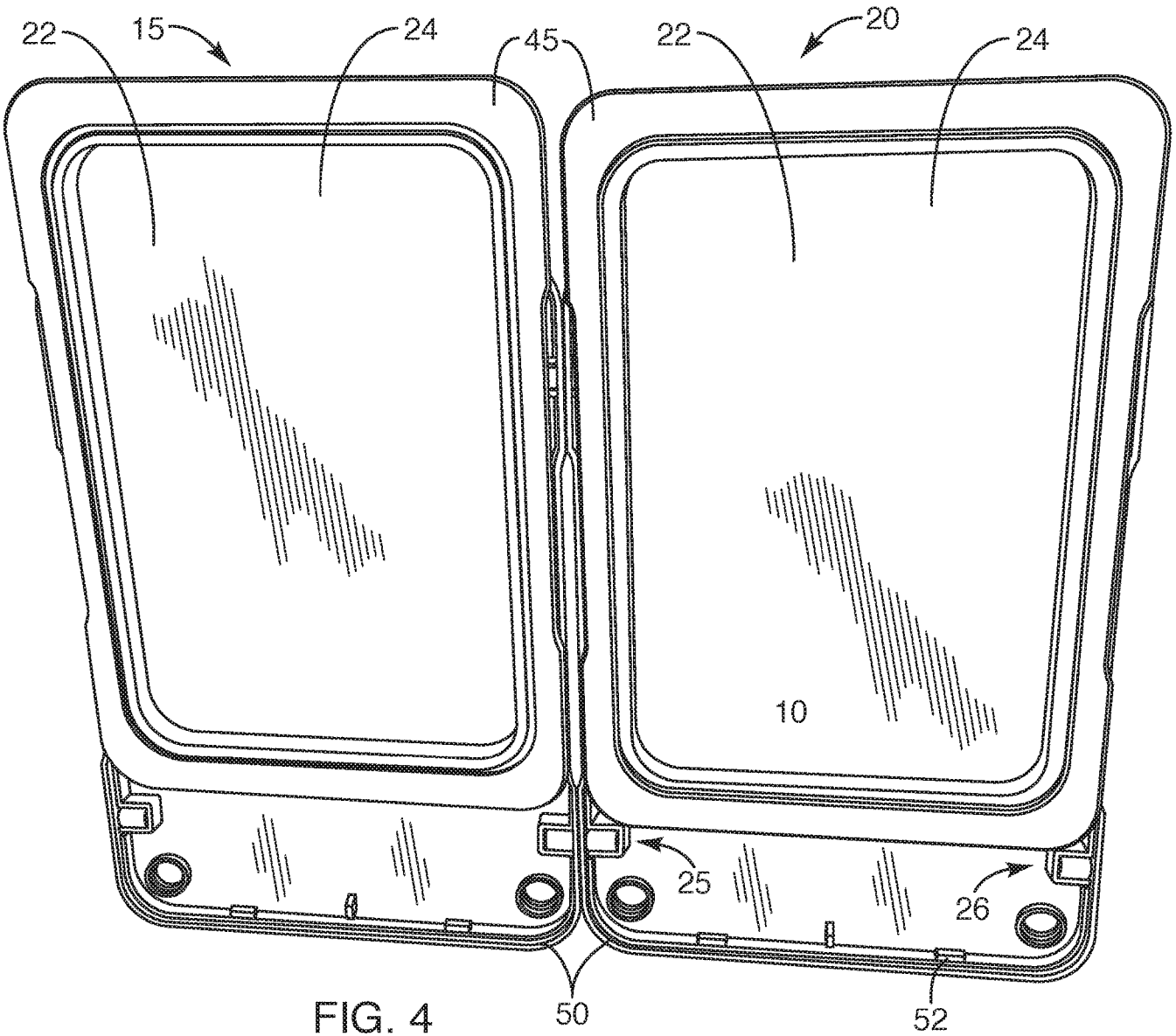
FIG. 4 illustrates a perspective view of the ink pad in a partially disassembled configuration in accordance with a representative embodiment.
Figure 5:
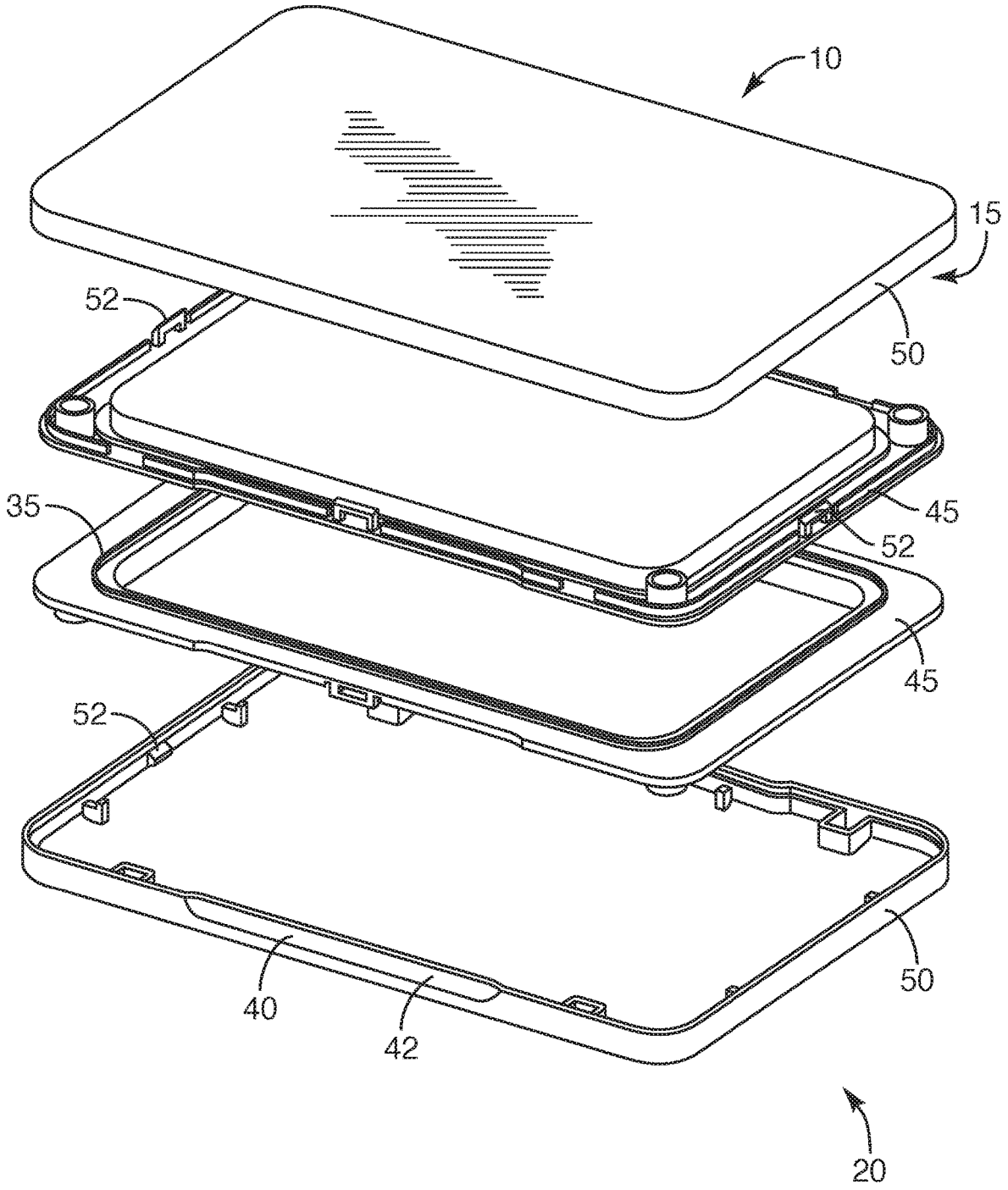
FIG. 5 illustrates an exploded perspective view of the ink pad in accordance with a representative embodiment.
Figure 7F:
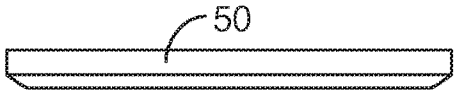
FIG. 7F illustrates an end or perimeter view of the exterior component of FIG. 7E.
Figure 7E:
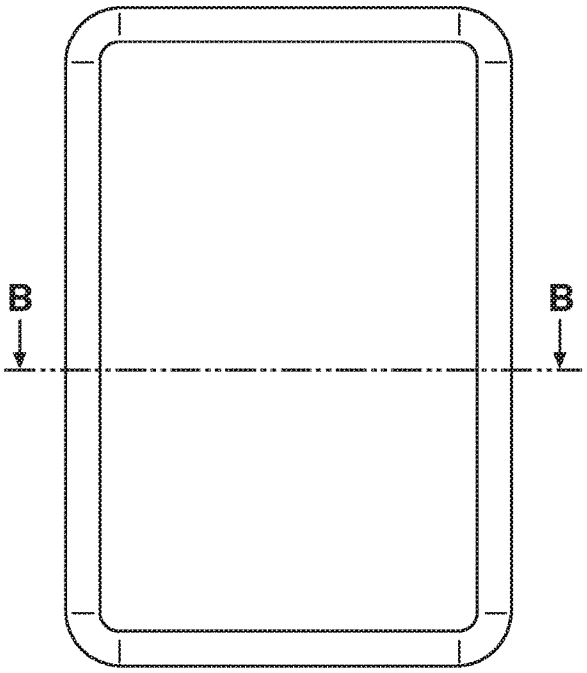
FIG. 7E illustrates a back side view of the exterior component of FIG. 7E.
Figure 7H:
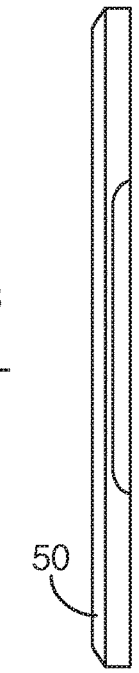
FIG. 7H illustrates a side or perimeter view of the exterior component of FIG. 7E.
Figure 7D:
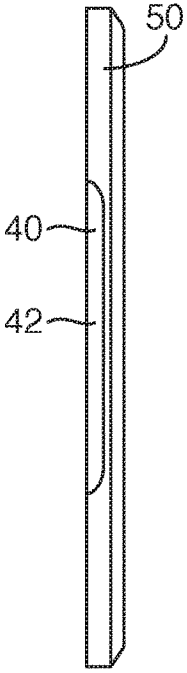
FIG. 7D illustrates a side view of the exterior component of FIG. 7A.
Figure 7G:
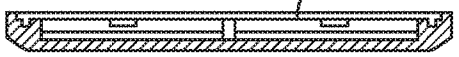
FIG. 7G illustrates a cross-sectional view of the exterior component of FIG. 7E, taken along line B-B.
Figure 7C:
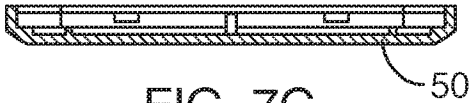
FIG. 7C illustrates a cross-sectional view of the exterior component of FIG. 7A, taken along line A-A.
Figure 7A:
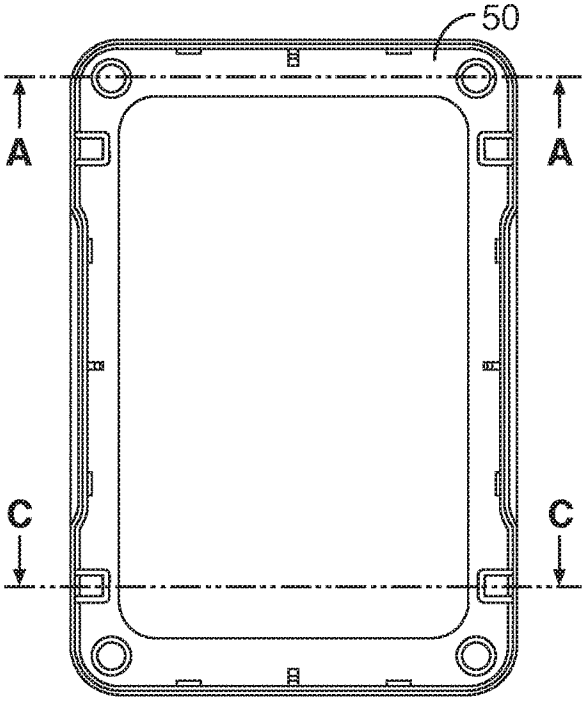
FIG. 7A illustrates a front side or internal view of an exterior component of the lid or the base of the ink pad in accordance with a representative embodiment.
Figure 7B:
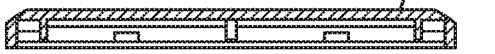
FIG. 7B illustrates a cross-sectional view of the exterior component of FIG. 7A, taken along line C-C.
Figure 8F:
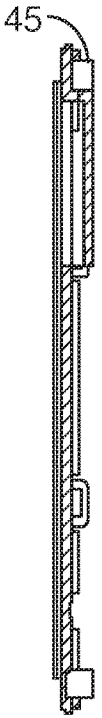
FIG. 8F illustrates a cross-sectional view of the interior component of FIG. 8E, taken along line B-B.
Figure 8E:
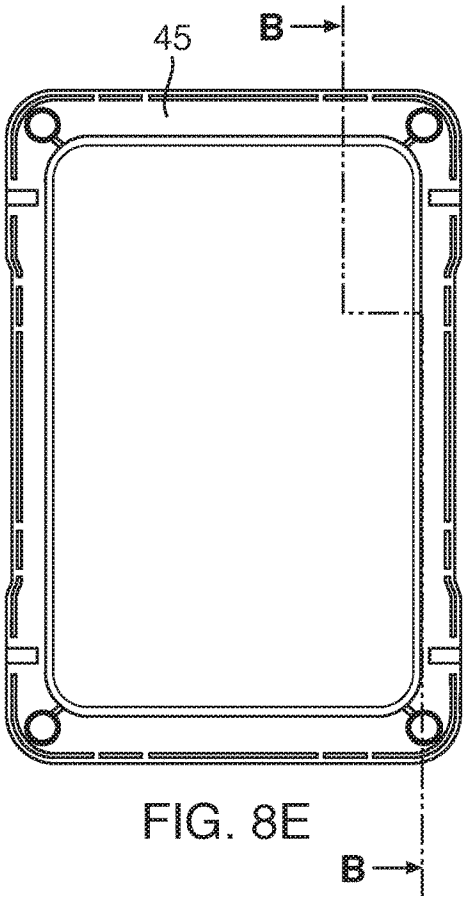
FIG. 8E illustrates a back side view of the interior component of FIG. 8A.
Figure 8D:
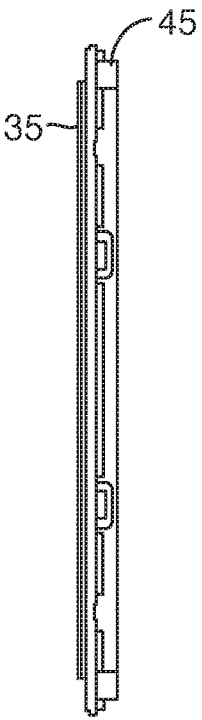
FIG. 8D illustrates a side view of the interior component of FIG. 8A.
Figure 8C:
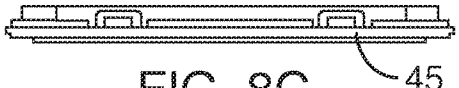
FIG. 8C illustrates an end or perimeter view of the interior component of FIG. 8A.
Figure 8A:
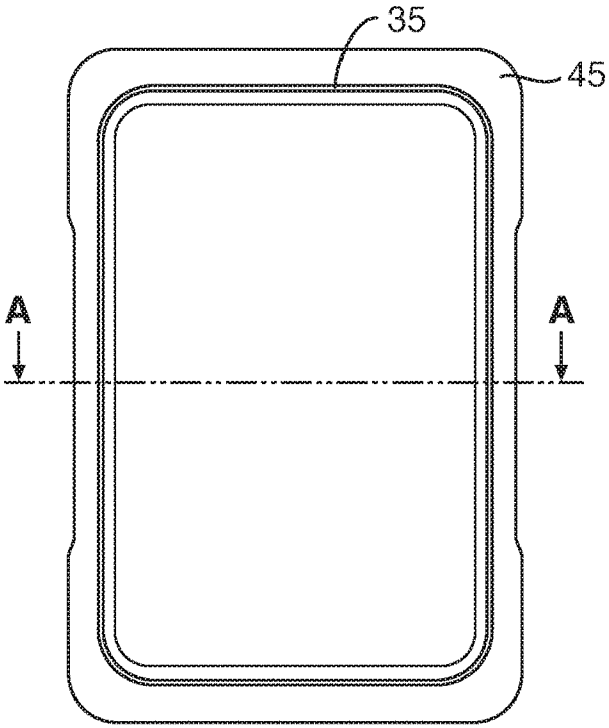
FIG. 8A illustrates a front side or face view of the interior component of the lid or the base of the ink pad in accordance with a representative embodiment.
Figure 8B:
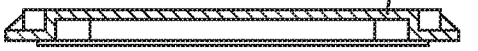
FIG. 8B illustrates a cross-sectional view of the interior component of FIG. 8A, taken along line A-A.
Figure 9A:
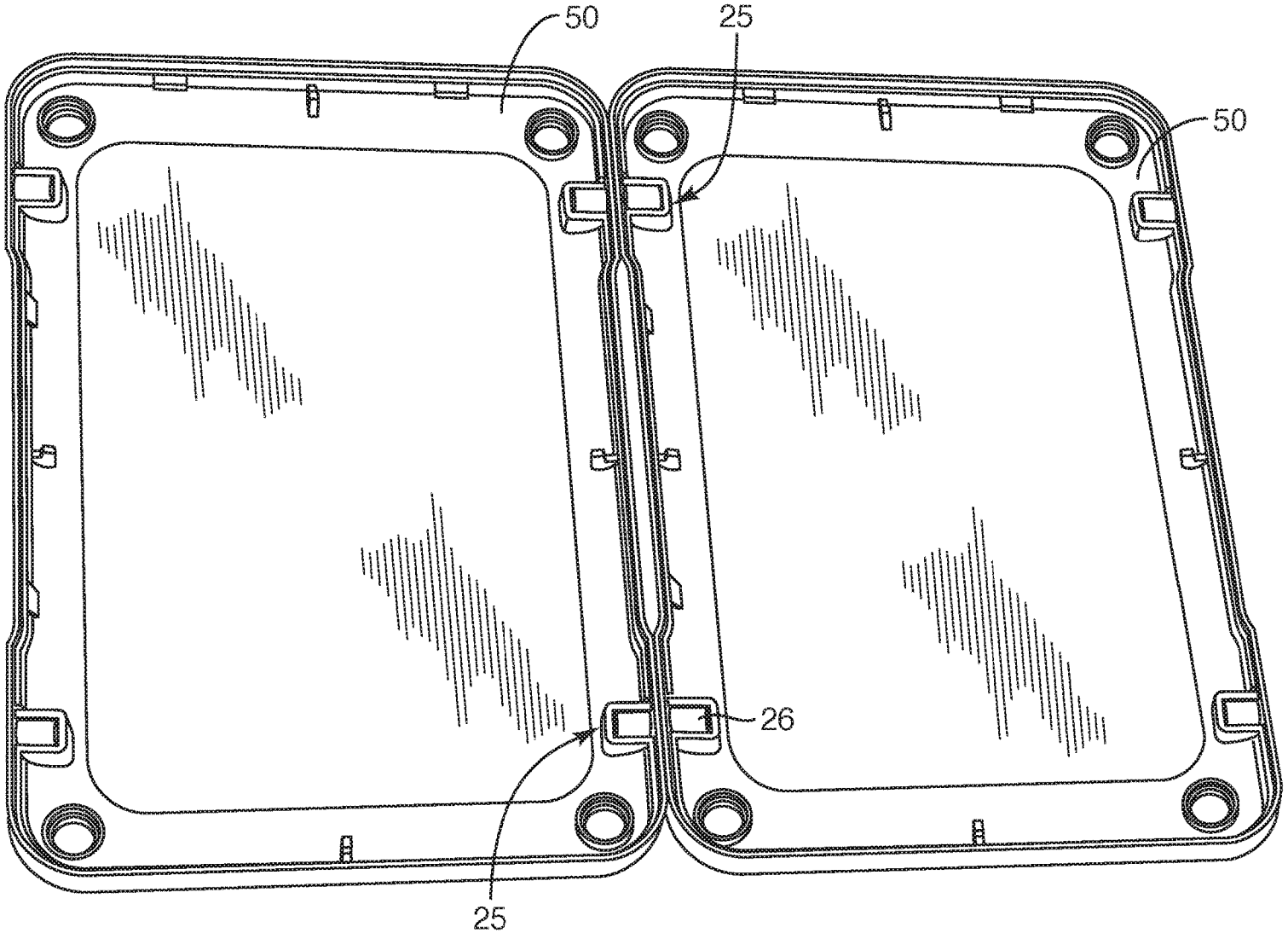
FIG. 9A illustrates a perspective view of interior surfaces of the exterior component of the lid and the base in accordance with a representative embodiment.
Figure 9B:
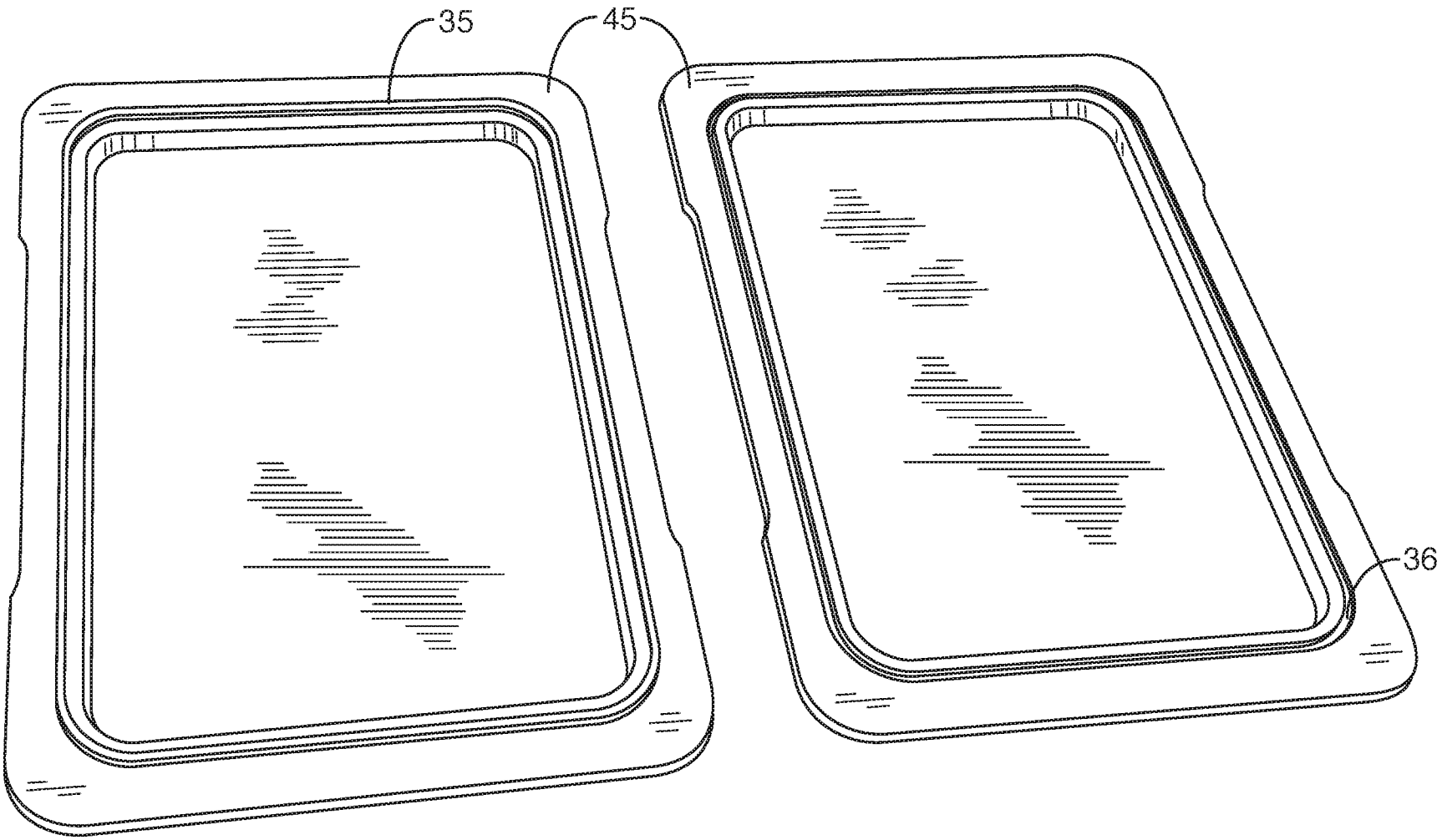
FIG. 9B illustrates a perspective view of the faces of the interior component of the lid and the base in accordance with some embodiments.

Although in some embodiments; the lid 15 and the base 20 each comprises a discrete monolithic component, in some other embodiments, the lid and/or the base each comprise multiple components that couple together to form the lid or the base. In this regard, the lid and the base may each comprise any suitable number of components that allow the ink pad 10 to function as described herein. By way of non-limiting illustration, FIGS. 4-9B show some embodiments in which the lid 15 and the base 20 each comprise an interior component 45 and an exterior component 50. In such embodiments, the interior and exterior components can couple with each other in any suitable manner, including, without limitation, via one or more frictional engagements, mechanical engagements, adhesives, fasteners (e.g., one or more screws, rivets, bolts, and/or other fasteners), and/or in any other suitable manner. Indeed, in some embodiments, the interior and exterior components couple together via an adhesive and/or one or more frictional engagements (e.g., via frictional engagements 52, as shown in FIGS. 4-5).

Figure 10:
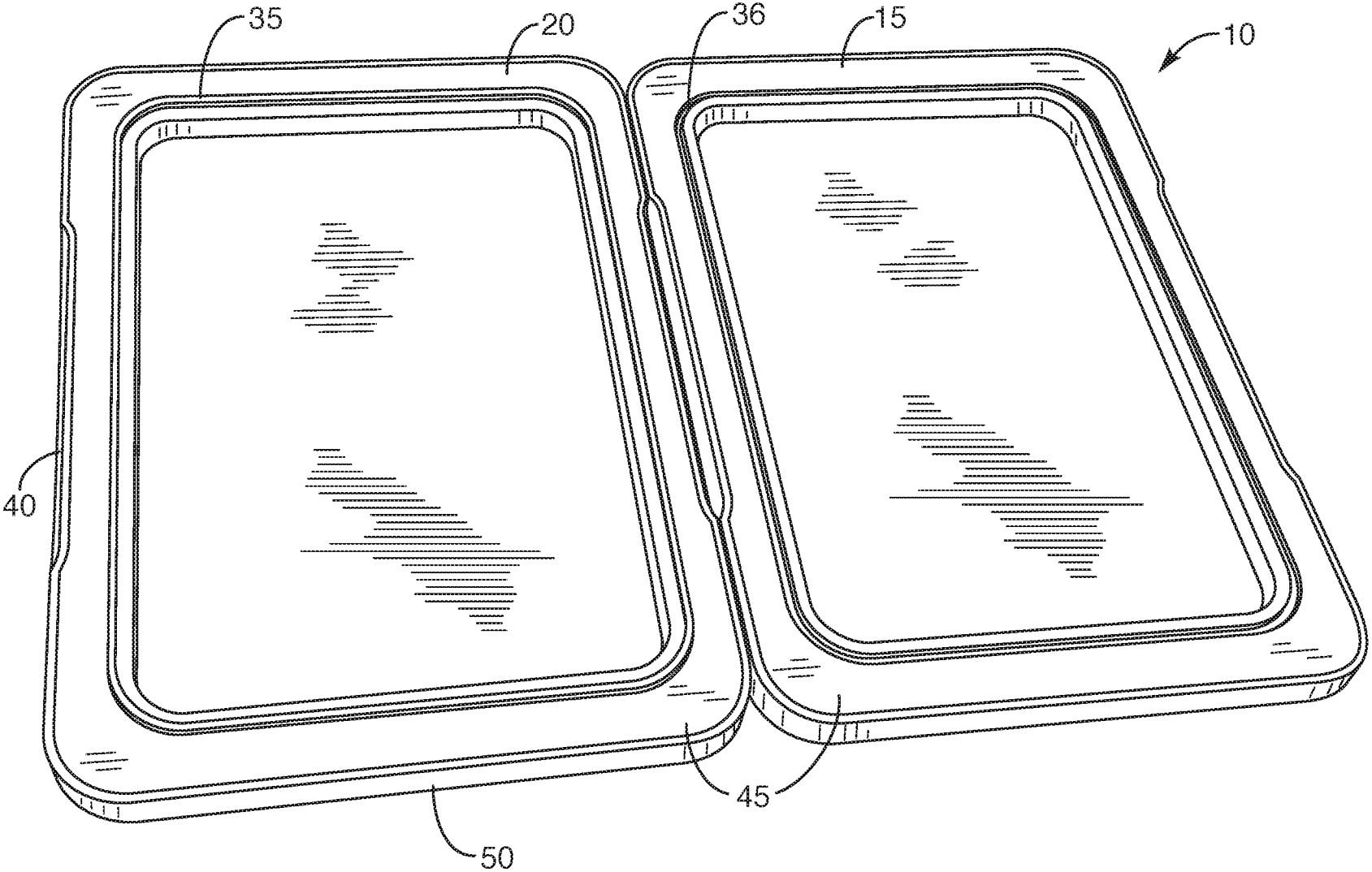
FIG. 10 illustrates a perspective view of the lid and the base magnetically coupled side by side, or perimeter to perimeter, in accordance with a representative embodiment.
Figure 11:
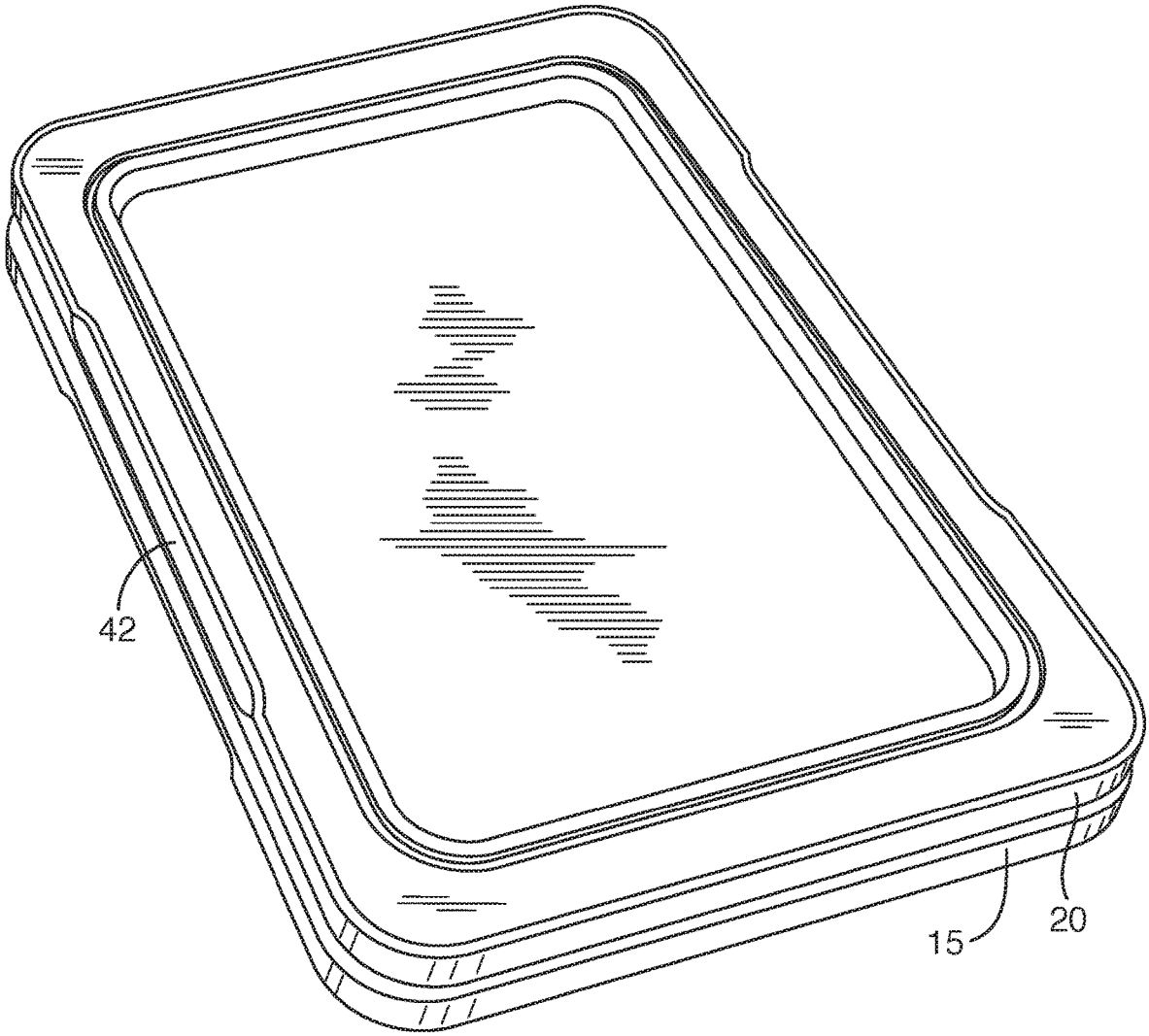
FIG. 11 illustrates a perspective view of the lid and the base magnetically coupled together in a back to back configuration in accordance with a representative embodiment.
Figure 12:
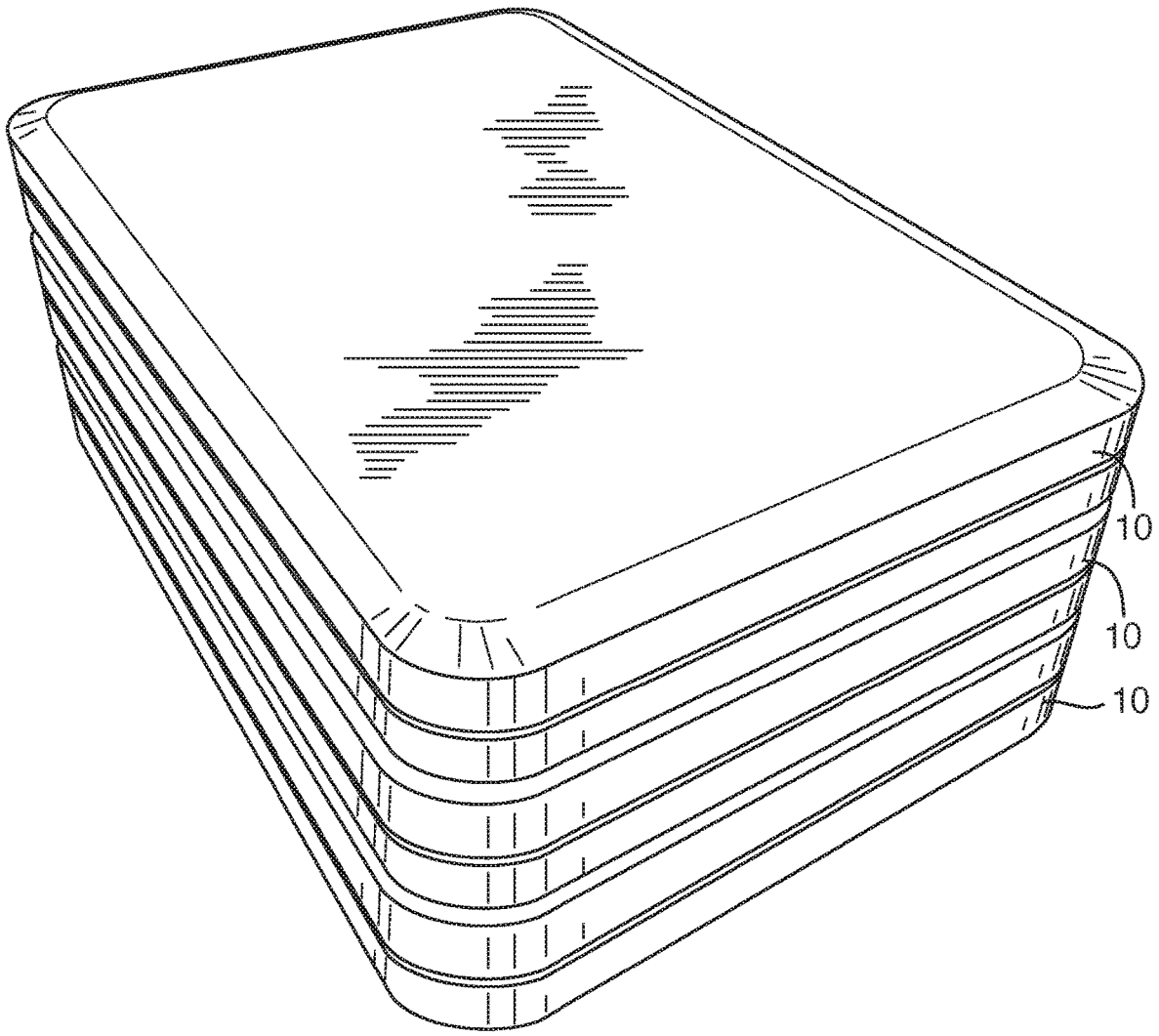
FIG. 12 illustrates a perspective view of multiple ink pads that are magnetically coupled together in accordance with a representative embodiment.

With respect to the coupling mechanism 25, the ink pad 10 can comprise any suitable coupling mechanism that allows the lid 15 and the base 20 to selectively couple to and decouple from each other relatively easily. In this regard, the coupling mechanism can allow the lid and base to couple to each other in any suitable manner, including, without limitation, by coupling with each other face to face (e.g., as shown in FIG. 1), by coupling with each other end to end (which term may be used interchangeably with the terms edge to edge, perimeter to perimeter, and side to side; e.g., as shown in FIG. 10), by coupling with each other back to back (e.g., as shown in FIGS. 11-12), by stackably coupling multiple ink pads (or portions of multiple ink pads) together e.g., as shown in FIG. 12), by coupling multiple ink pads (e.g., the lids and/or bases from multiple ink pads) together edge to edge (or perimeter to perimeter, side to side, end to end, etc.), by coupling one portion of the ink pad (e.g., the lid or base) at angle to another portion of the ink pad (e.g., the lid or base), and/or by coupling one or more portions of one or more ink pads together in any other suitable manner.

Some examples of suitable coupling mechanisms 25 comprise one or more magnetic couplers, snaps, hook-and-loop fasteners, clasps, catches, mechanical engagements, frictional engagements, adhesive engagements, and/or other suitable engagements that are configured to selectively couple the lid 15 and the base 20 together in a manner that allows them to be coupled and decoupled relatively easily. In some embodiments, however, the coupling mechanism comprises one or more magnetic couplers.

Where the coupling mechanism 25 comprises one or more magnetic couplers, the magnetic couplers can comprise any suitable type of magnets and/or corresponding magnetic materials (e.g., ferromagnetic materials, paramagnetic materials, and/or any other suitable materials that are attracted to a magnet used in a magnetic coupler and that are suitable for use in the ink pad 10). Some non-limiting examples of such magnets comprise any suitable type of magnets, including, without limitation, one or more magnets comprising neodymium-iron boron, samarium-cobalt, one or more ceramics, one or more ferrites, one or more sintered composites comprising powdered iron oxide and barium/strontium carbonate ceramic, alnico, magnetite, lodestone, cobalt, nickel, iron, gadolinium, dysprosium, one or more iron alloys, one or more types of steel, one or more rare earth metals, and/or any other suitable type of material or materials that have magnetic properties and are attracted to one or more magnetic materials (as discussed below). Additionally, where the magnetic couplers comprise one or more magnetic materials, such materials can comprise any suitable material, including, without limitation, iron, nickel, cobalt, and/or any other suitable ferromagnetic, paramagnetic, and/or other material that is attracted to a magnet in a magnetic coupler and that is suitable for use in the ink pad 10.

Where the ink pad 10 comprises a set of magnetic couplers (with each set comprising at least two magnets or at least one magnet and a corresponding magnetic material), the magnetic couplers can be configured in any suitable manner that allows the lid 15 and base 20 to couple with each other as described herein. In some embodiments, the lid and the base each comprise a portion of a set of magnetic couplers. Indeed, in some embodiments, one of the base and the lid comprises a first magnet and the other of the base and the lid comprises a second magnet that is disposed in a position that corresponds to a position of the first magnet such that the base and the lid can be magnetically and releasably coupled together via the first and second magnets. In some other embodiments, one of the base and the lid comprises a first magnet and the other of the base and the lid comprises a first magnetic material (e.g., a piece of metal) that is disposed in a position that corresponds to a position of the first magnet such that the base and the lid can be magnetically and releasably coupled together via the first magnet and the first magnetic material.

Figure 13A:
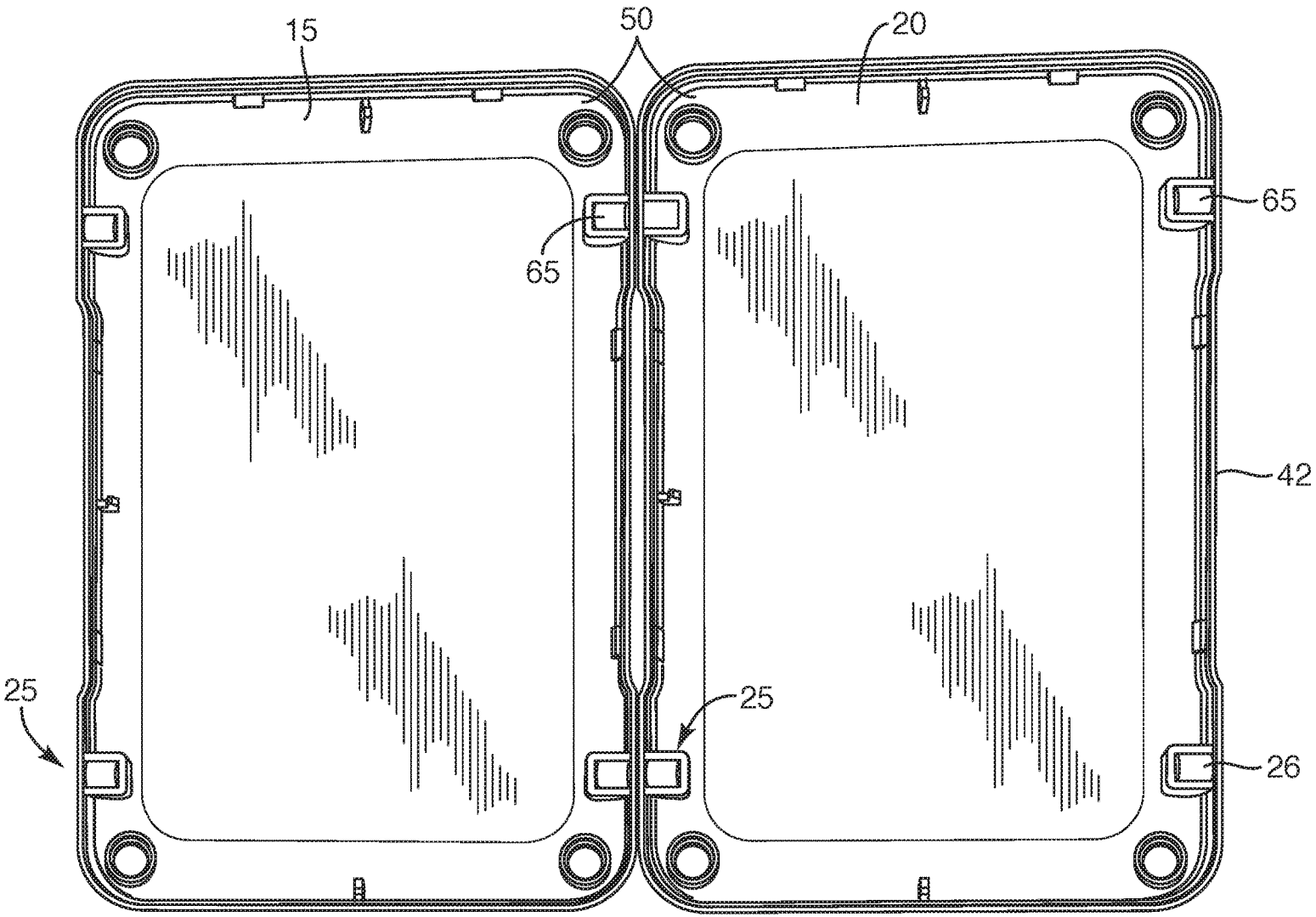
FIGS. 13A-14 each illustrate a different view of one or more portions of the ink pad in accordance with some embodiments.
Figure 13B:
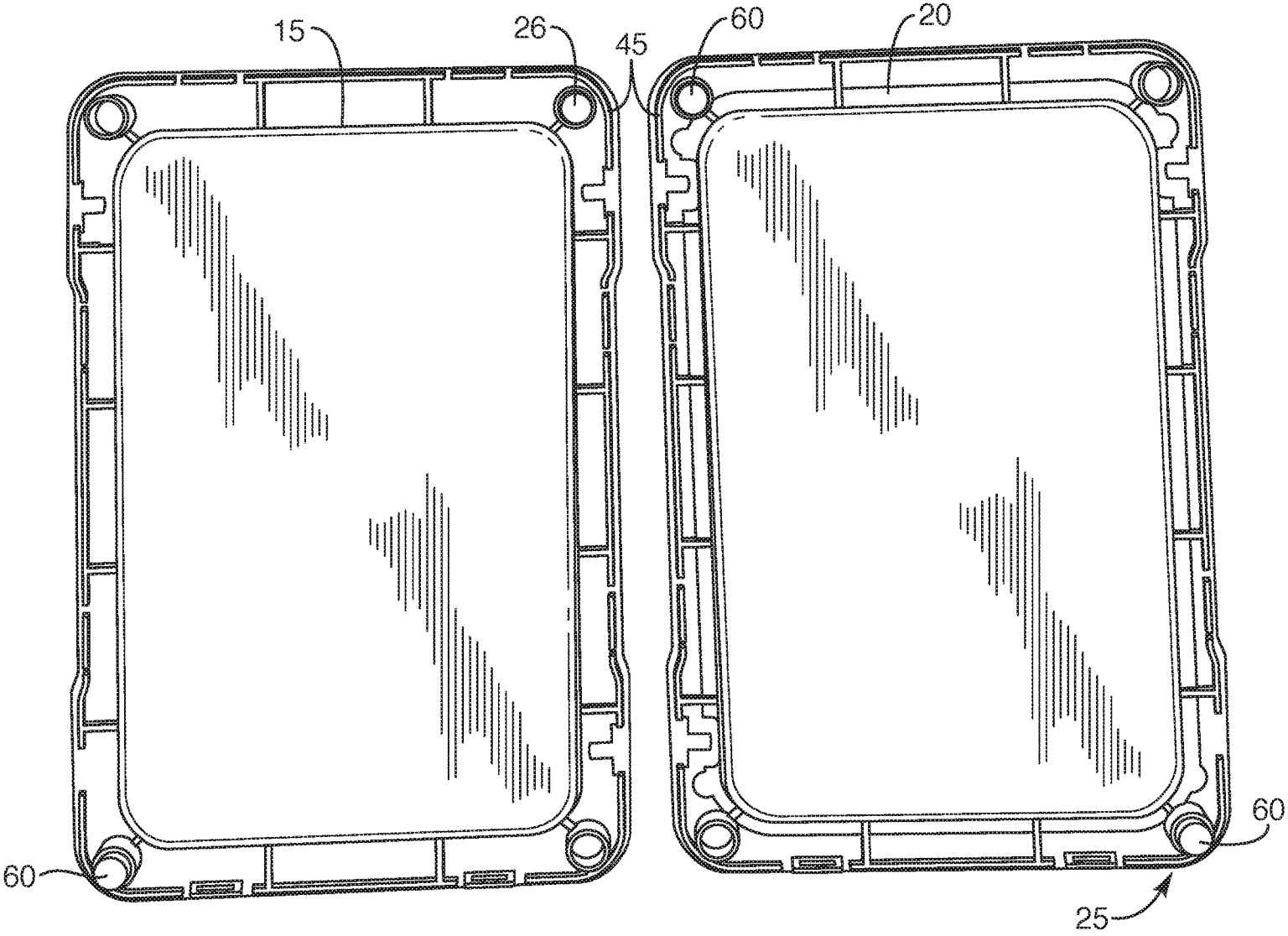
Figure 13C:
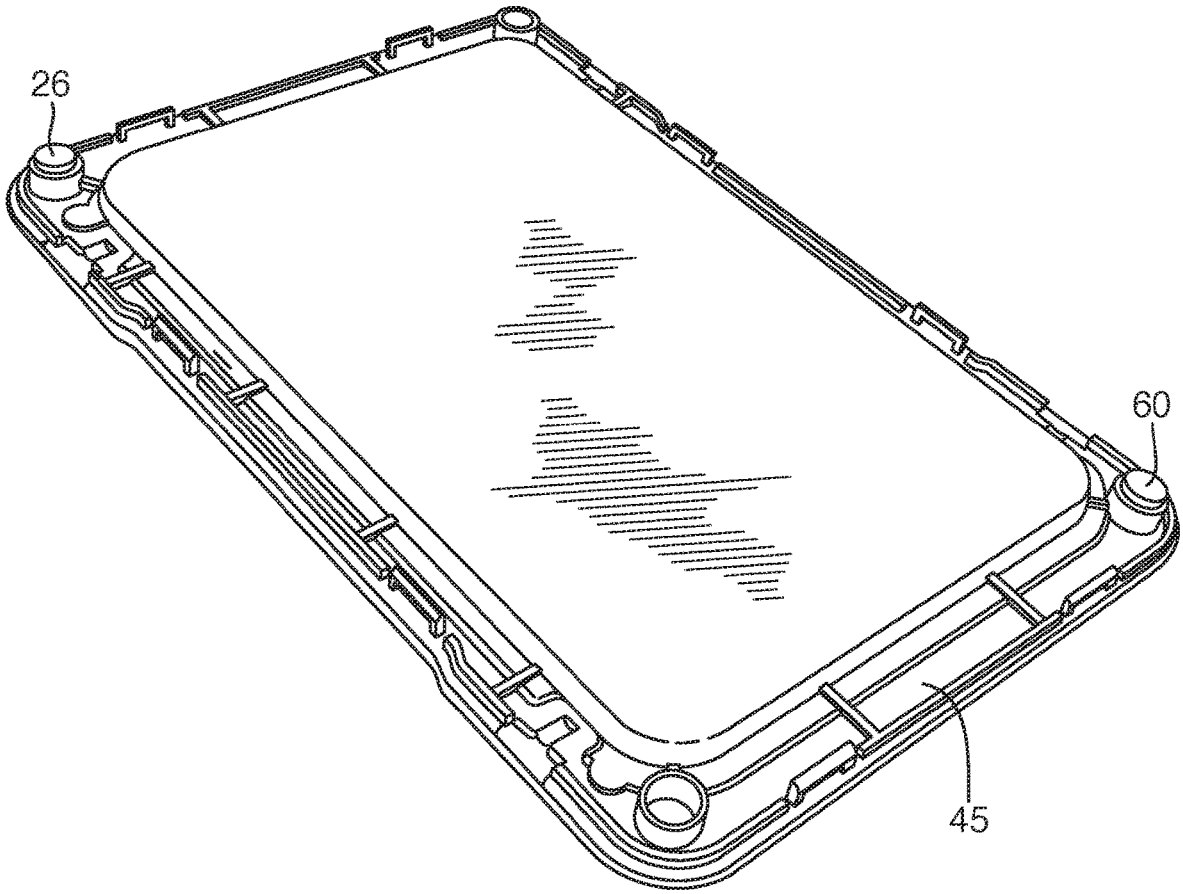

Although some embodiments of the ink pad 10 comprise a single set of magnetic couplers (e.g., a two corresponding magnets or one magnet and a corresponding magnetic material), in some other embodiments, the ink pad comprises 2, 3, 4, 5, 6, 7, 8, or any other suitable number of sets of magnetic couplers. Indeed, in some non-limiting embodiments (e.g., as illustrated in FIGS. 9A, and 13A-13C), the ink pad comprises 6 sets of magnetic couplers 26 (e.g., with 6 magnets and/or magnetic materials in the lid 15 and 6 corresponding magnets and/or magnetic materials in the base 20). Additionally, FIGS. 13A-13B show some embodiments in which the lid 15 and base 20 each comprise at least two magnets 60 in their interior component 45, and at least four magnets 65 and/or magnetic materials in their exterior component 50. Although in some embodiments, the interior component comprises 4 or more magnets 60 or magnetic materials, FIG. 13C illustrates an embodiment in which the interior component comprises two magnets 60.

Figure 14:
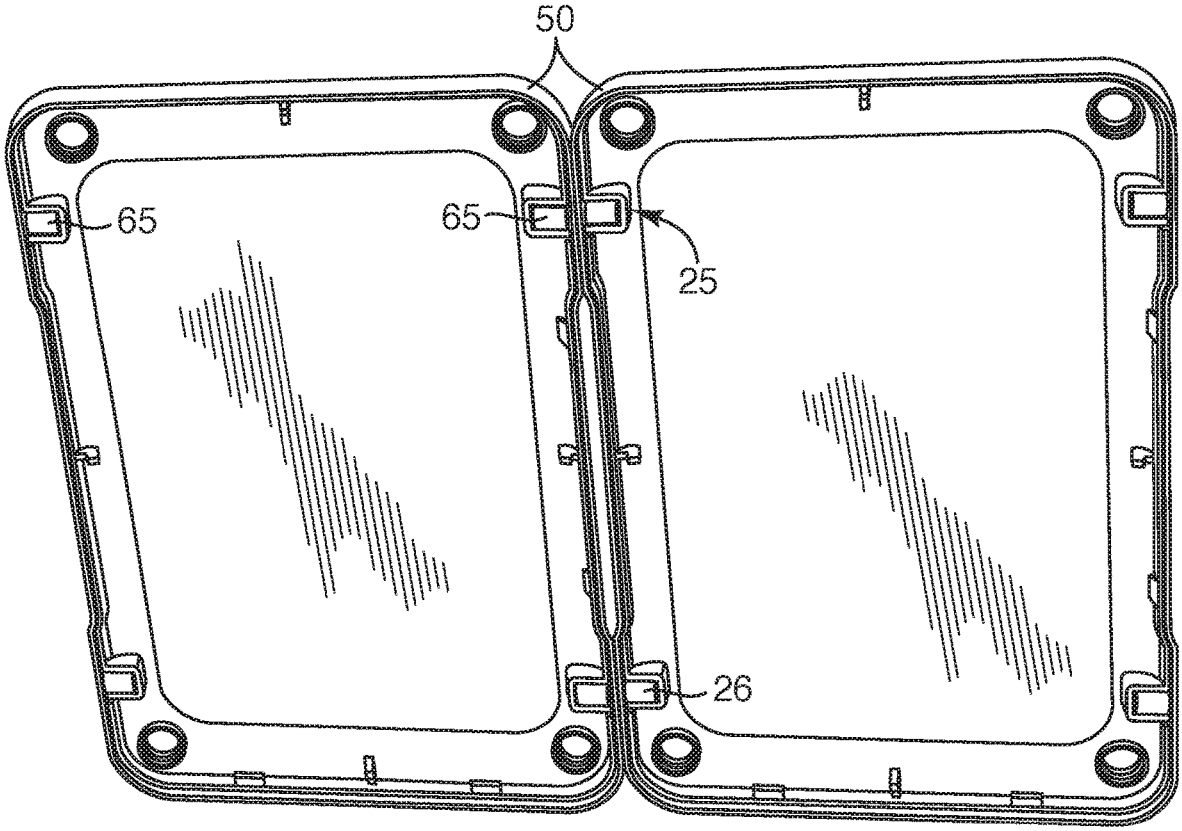

In some embodiments in which the ink pad 10 comprises more than one set of magnetic couplers 26, the ink pad comprises (1) at least one set of magnetic couplers that is configured to couple the base 20 and lid 15 in a face to face configuration (or a closed configuration; e.g., as shown in FIG. 1), a back to back configuration (e.g., as shown in FIG. 11), and/or in any other suitable configuration; and (2) at least one set of magnetic couplers that is configured to couple the base and lid in a side to side or perimeter to perimeter configuration as shown in FIGS. 10 and 14) and/or in any other suitable configuration. While this can be accomplished in any suitable manner, FIG. 13A shows an embodiment in which a first set of magnetic couplers (e.g., magnets 65) is aligned with the magnets' poles in a first plane (or orientation) to connect the lid 15 and base 20 together in a side to side configuration, while FIG. 13B shows another embodiment in which a second set of magnetic couplers (e.g., magnets 60) have their poles in a different position (or orientation) than the poles of the first set of magnetic couplers. In this regard, while the first and second sets of magnetic couplers can have any suitable orientation with respect to each other (e.g., being substantially perpendicular to, orthogonal to, parallel with, at an angle to, and/or in any other suitable configuration with respect to each other), FIGS. 13A and 13B show that, in some embodiments, the two sets of magnetic couplers are oriented substantially perpendicular to each other (e.g., to hold the lid and base together in a face to face, back to back, and perimeter to perimeter configuration).

Additionally, while the magnetic couplers 26 can be disposed in any suitable location on the ink pad 10, FIGS. 13A-13B illustrate some embodiments in which magnets 65 from the first set of magnetic couplers are coupled in the ink pad 10 with a pole facing a side of the lid 15 or the base 20 and in which magnets 60 of the second set of magnetic couplers have a pole facing a face and/or back of the lid 15 and/or the base 20. Moreover, while FIG. 13B shows an embodiment in which two magnets 60 are disposed in opposite corners of the interior component 45, in some embodiments shown), one or more magnets and/or pieces of metal (e.g., any suitable metal or other magnetic material that is attracted to the magnets) is disposed in the other corners (and/or any other suitable portion) of the interior comport (and/or any other suitable portion of the ink pad).

Figure 15:
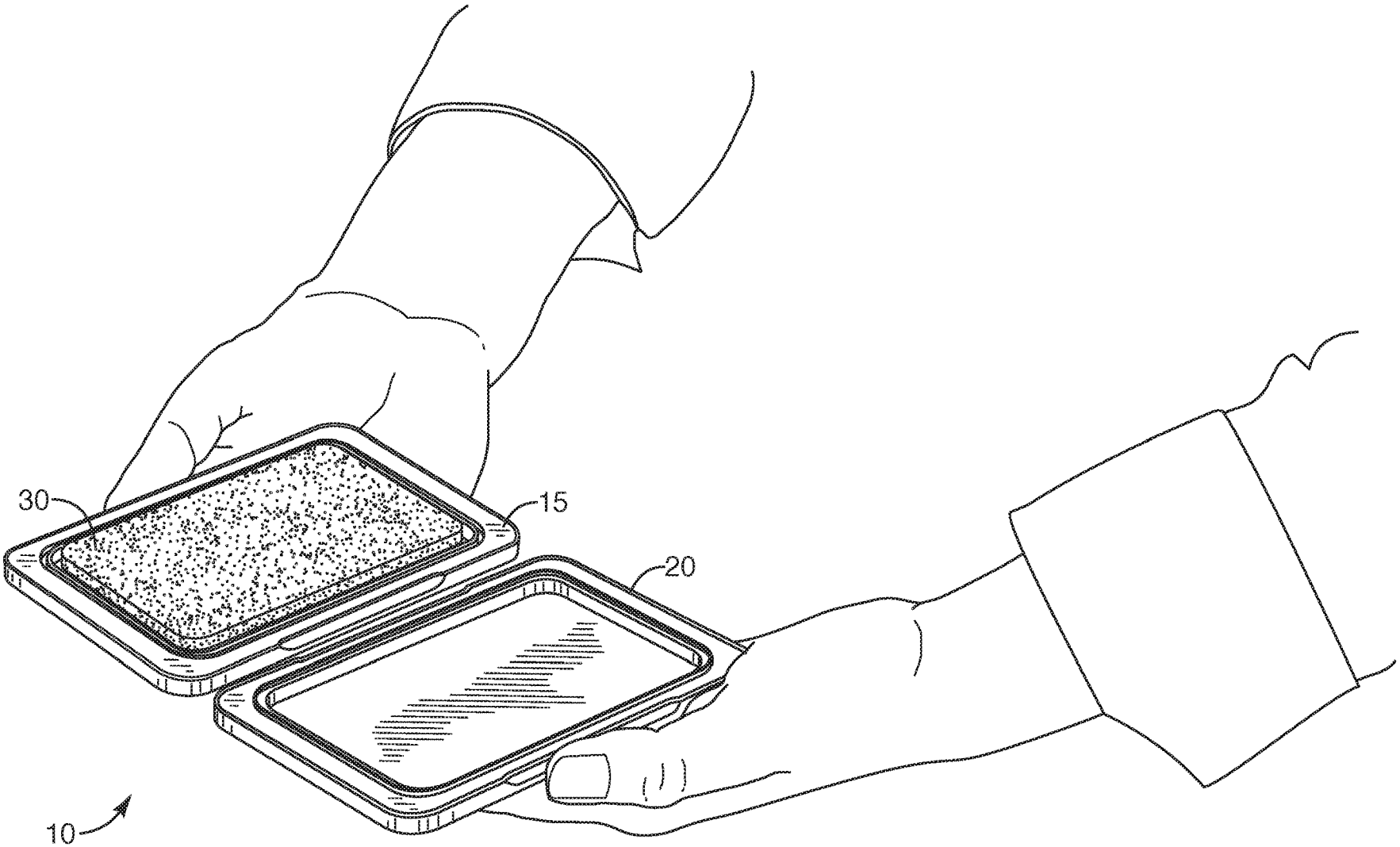
FIGS. 15-18 illustrate additional views of some embodiments of the ink pad.
Figure 16:
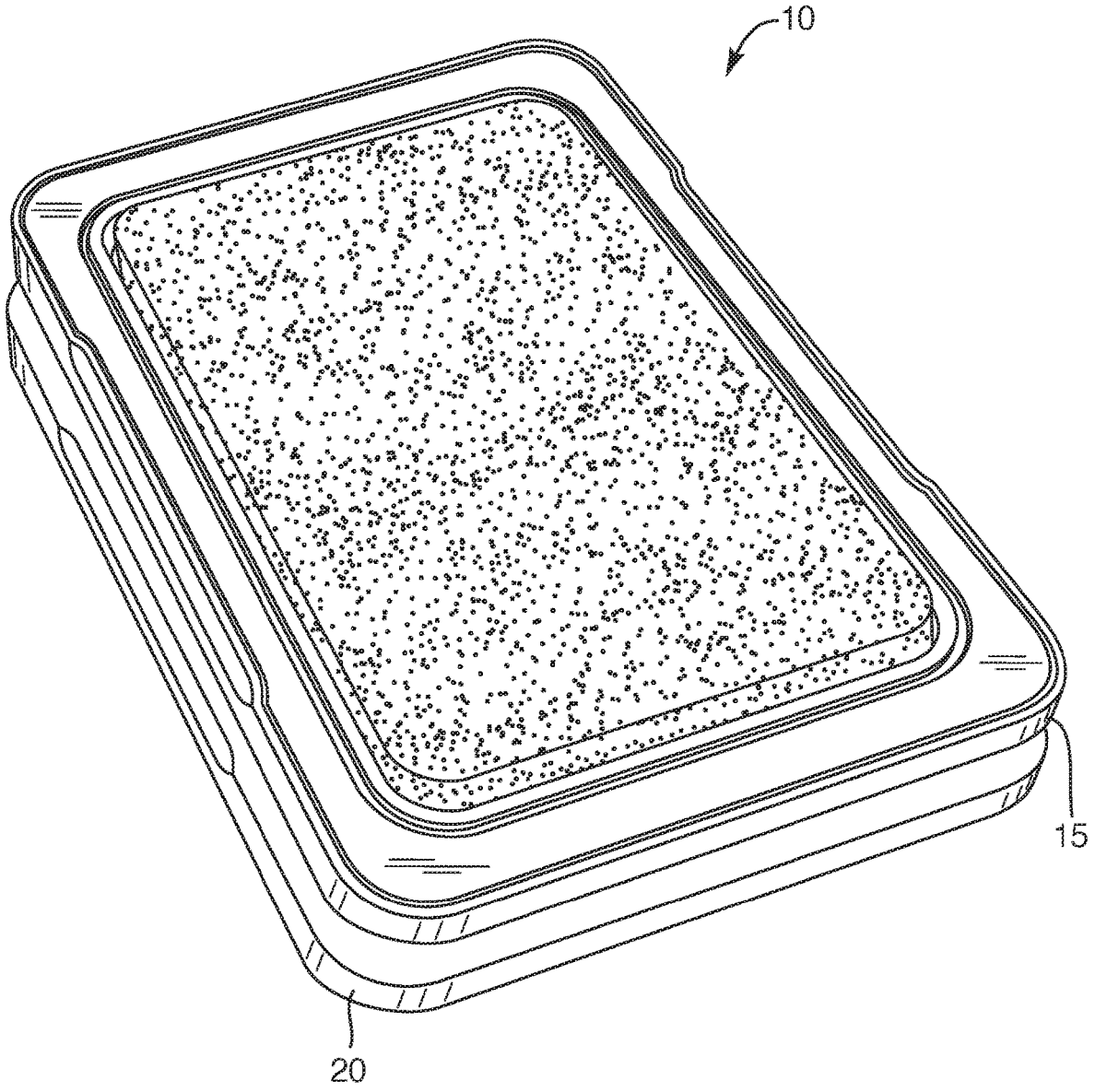

With respect now to the absorbent material 30, the ink pad 10 can comprise any suitable number of pads (e.g., 1, 2, 3, 4, 5, 6, 7, 8, 9, 10, or more), of any suitable shape (e.g., substantially rectangular, square, triangular, circular, polygonal, and/or any other suitable shape), and in any configuration (e.g., one absorbent material per ink pad, a plurality of ink pads organized as a palette in the ink pad, and/or any other suitable configuration). By way of non-limiting illustration, FIG. 15 shows an embodiment in which the ink pad 10 comprises a single absorbent material 30 that is substantially rectangular with rounded corners.

The absorbent material 30 can comprise any suitable material that is configured to absorb, store, and/or otherwise retain one or more inks, pigments, and/or other suitable substances that are desirably transferred from the absorbent material to another surface (e.g., via a stamp, finger, roller, and/or other transfer substrate) to create a desired pattern. In this regard some non-limiting examples of suitable absorbent materials include one or more pieces of felt, cloth, sponge, polychloroprene, cotton, foam, sponge foam, foamed rubber, foam, fabric, paper, plastic, a substrate (e.g., for an inkless pigment or otherwise), porous materials, spongy materials, and/or any other suitable material. For instance, FIG. 15 shows an embodiment in which the absorbent material 30 comprises a sponge foam.

Turning now to the seals 35, the ink pad 10 optionally comprises one or more seals that help limit air flow into and/or out of the ink pad when the pad is in the closed position. In this regard, the ink pad can comprise any suitable seal that is capable of limiting air flow into and/or from the pad when the pad is in the closed position. Indeed, in some embodiments, the lid 15 and/or the base 20 comprise one or more ridges, protrusions, and/or other seals that extend from the internal face (e.g., of the interior component 45 and/or the exterior component 50). While, in some embodiments, such seals contact a flat surface on the opposing lid or base, in some other embodiments, one or more seals extending from the lid and/or base are configured to extend into one or more corresponding recesses in the other of the lid and/or base when the ink pad is in the closed position. By way of non-limiting illustration, FIGS. 2-4, 6G, 8A, and 18 each illustrate that, in some embodiments in which the lid 15 or the base 20 comprises one or more seals 35 that comprises one or more raised ridges, the other corresponding component (e.g., the lid or base) comprises one or more corresponding recesses 36 that are configured to receive the seals.

With respect now to the gripping surfaces 40, the lid 15 and/or base 20 can comprise any suitable gripping surfaces that allow a user to easily grab both the lid and the base and to separate to the two components. Some examples of suitable gripping surfaces comprise one or more ridges, processes, bumps, knurled surfaces, roughened surfaces, recesses, depressions, finger holds, tacky areas, and/or other features that make it relatively easy for a user to grab and separate the lid and the base. By way of non-limiting illustration, FIGS. 1, 3, and 15 show some embodiments in which both the lid 15 and the base 20 comprise an elongated recess 42 that functions as the gripping surface 40.

The described ink pad 10 can be any suitable shape. Indeed, in some embodiments, the ink pad is substantially square, rectangular, triangular, hexagonal, octagonal, pentagonal, polygonal, circular, elliptical, cuboidal, prism shaped (e.g., rectangular prism, triangular prism, square prism, and/or any other suitable prism shape), symmetrical, asymmetrical, regular shaped, irregularly shaped, and/or any other suitable shape. By way of non-limiting illustration, FIG. 1 shows an embodiment in which the ink pad 10 is substantially rectangular in shape (e.g., a rectangular prism, having rounded edges and corners).

The described ink pad 10 can be any suitable size that allows it to function as described herein. In some embodiments, however, the length and width of the ink pad are each between about 0.5 cm and about 46 cm, or any subrange thereof. Indeed, in some embodiments, the length and width are between about 4 cm and about 20 cm (e.g., between about 6 cm and about 16 cm). Additionally, as some embodiments of the ink pad are not square, the length and width of the ink pad need not be equal. For instance, some embodiments of the ink pad have a width that is between about 6 cm and about 10 cm and a length that is between about 9 cm and about 15 cm (each falling in the aforementioned range of between about 0.5 cm and about 46 cm). Indeed, in some embodiments, the ink pad has a length of about 12.5 cm and a width of about 8.5 cm.

The ink pad 10 can further have any suitable thickness. Indeed, in some embodiments, when the ink pad is in a closed position (e.g., as shown in FIG. 1), the ink pad has a thickness that is between about 0.3 cm and about 5 cm (or any subrange thereof). For instance, some embodiments of the ink pad are between about 0.8 cm and about 3 cm thick (e.g., between about 1 cm and about 2 cm thick).

Figure 17:
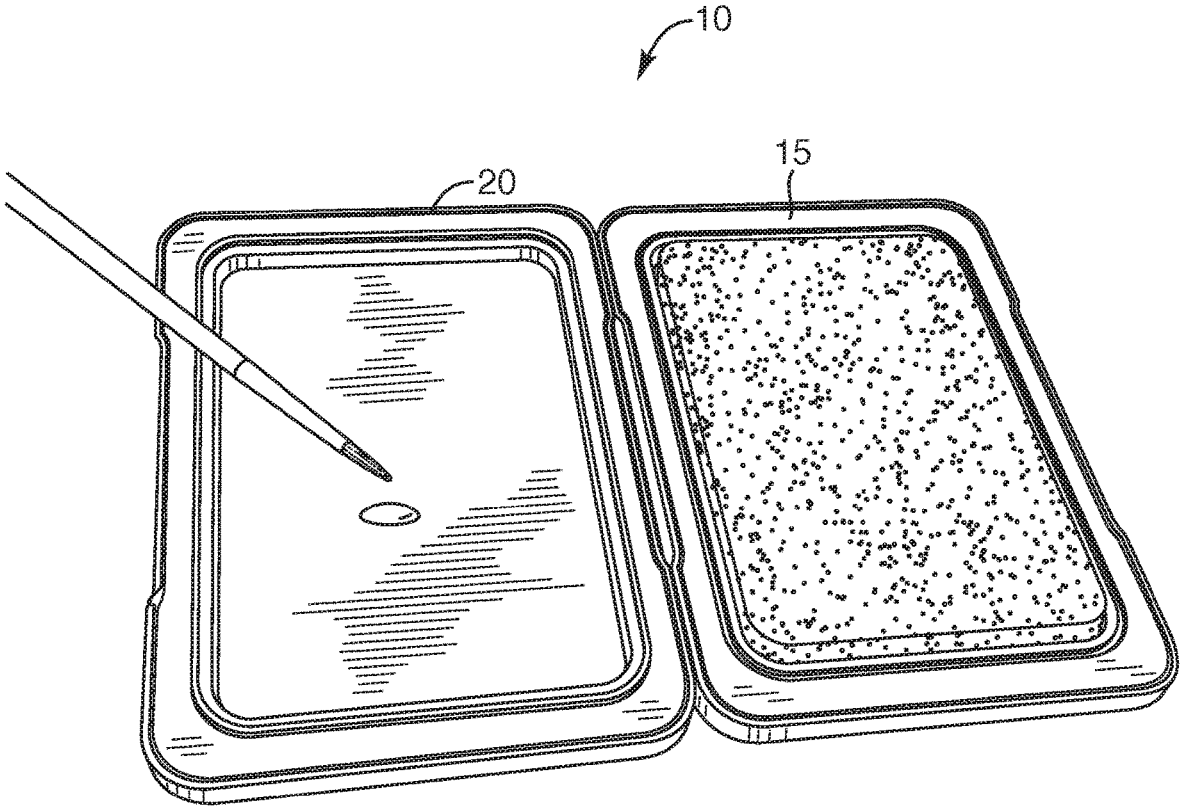
Figure 18:
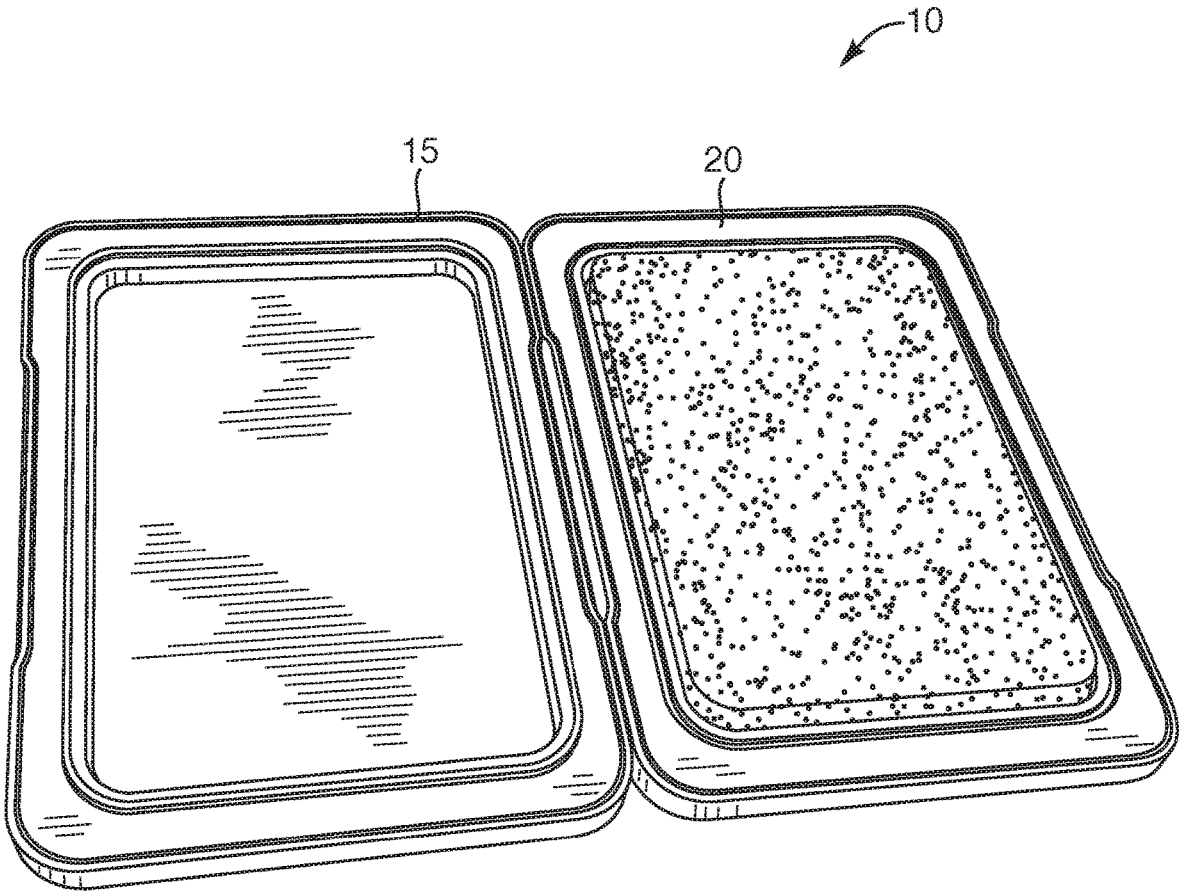

In addition to the aforementioned components, the described ink pad 10 can comprise any other suitable component. Some examples of such components include, but are not limited to, one or more brushes; applicators; lights; electronic devices; wipes; cleaners; mirrors; stamps; glues; dividers (e.g., to separate one or more pieces of absorbent materials comprising ink (or other pigments) from one or more other pieces of absorbent materials comprising one or more other inks (or other pigments); and/or other suitable objects or materials. By way of non-limiting illustration, FIG. 17 shows some embodiments in which the pad 10 is used as a palette for applying paint, ink, and/or any other suitable transferable medium to a desired substrate.

Additionally, the described ink pad 10 can have any other suitable characteristic that allows it to operate as intended. Indeed, in some embodiments, the ink pad is ergonomically shaped to be more comfortable and easy to use than some conventional ink pads. Additionally, although some embodiments of the lid 15 and/or the base 20 are opaque, in some other embodiments, the lid and/or the base comprise a translucent and/or transparent object, or an object having a translucent and/or transparent portion. In some such embodiments, a user is able to attach a stamp to an outer surface of the ink pad (e.g., the lid or the base), and is then able to see through the lid or base to properly position the stamp. Additionally, while some embodiments of the described ink pad comprise a lid 15 and base 20 that are hingedly coupled together and further comprise one or more magnetic (or other suitable) coupling mechanisms, in some other embodiments, however, (as shown the figures) the lid 15 and the base 20 each comprise discrete objects that are not coupled together with a hinge.

Thus, as discussed herein, some embodiments of the present invention relate to ink pads. In particular, some embodiments of the present invention relate to systems and methods for providing an ink pad that is easily opened and sealed shut. In some implementations, the described ink pad comprises a lid and a base that are configured to couple with each other via one or more magnets and/or other coupling mechanisms.

The present invention may be embodied in other specific forms without departing from its spirit or essential characteristics. The described embodiments, examples, implementations, and illustrations are to be considered in all respects only as illustrative and not restrictive. The scope of the invention is, therefore, indicated by the appended claims rather than by the foregoing description. All changes that come within the meaning and range of equivalency of the claims are to be embraced within their scope. In addition, as the terms on, disposed on, attached to, connected to, coupled to, etc. are used herein, one object (e.g., a material, element, structure, member, etc. can be on, disposed on, attached to, connected to, or coupled to another object—regardless of whether the one object is directly on, attached, connected, or coupled to the other object, or whether there are one or more intervening objects between the one object and the other object. Also, directions (e.g., horizontal, vertical, front back, on top of, below, above, top, bottom, side, up, down, under, over, upper, lower, lateral, etc.), if provided, are relative and provided solely by way of example and for ease of illustration and discussion and not by way of limitation. Where reference is made to a list of elements e.g., elements a, b, c), such reference is intended to include any one of the listed elements by itself, any combination of less than all of the listed elements, and/or a combination of all of the listed elements. Furthermore, as used herein, the terms "a," "an," and "one" may each be interchangeable with the terms at least one and one or more.

What is claimed is:

1. An ink pad, comprising:

a lid having a first magnetic coupler and a second magnetic coupler, wherein the first magnetic coupler comprises a first magnetic axis running in a first direction between a north pole and a south pole of the first magnetic coupler, wherein the second magnetic coupler comprises a second magnetic axis running in a second direction between a north pole and a south pole of the second magnetic coupler, and wherein the first and second magnetic axes run in different directions and at an intersecting angle to each other;

a base having a third magnetic coupler and a fourth magnetic coupler; and an absorbent material that is configured to receive and store an amount of a transferable pigment, wherein the first magnetic coupler and the third magnetic coupler are configured to magnetically couple the lid and the base together in a face to face configuration so as to define a cavity that houses the absorbent material, and wherein the second magnetic coupler and the fourth magnetic coupler are configured to be magnetically coupled together to couple the lid and the base together in a side to side configuration, such that a first side face of the lid and a first side face of the base are abutted against, and are magnetically coupled to, each other.

2. The ink pad of claim 1, wherein at least one of the lid and the base comprise a substantially planar first face that extends around and defines a recess that is configured to form at least part of the cavity, wherein the at least one of the lid and the base comprises a first seal component having a seal that extends from the first face such that the seal is configured to be disposed between the lid and the base when the ink pad is in the face to face configuration, wherein the other of the at least one of the lid and the base comprises a second seal component, and wherein the seal of the first seal component is configured to extend into a recess that is defined in the second seal component.

3. The ink pad of claim 1, wherein the lid further comprises a fifth magnetic coupler and a sixth magnetic coupler, wherein the second magnetic coupler is disposed adjacent to the first side face of the lid, wherein the sixth magnetic coupler is disposed adjacent to a second side face of the lid, the second side face of the lid being disposed opposite to the first side face of the lid, wherein the sixth magnetic coupler comprises a third magnetic axis that runs between a north pole and a south pole of the sixth magnetic coupler, and wherein the third magnetic axis runs parallel with the second magnetic axis.

4. The ink pad of claim 3, wherein the first and second magnetic couplers are disposed adjacent to each other, and wherein the first magnetic coupler is disposed at a corner of the lid.

5. The ink pad of claim 3, wherein the fifth magnetic coupler comprises a fourth magnetic axis that extends between a north pole and a south pole of the fifth magnetic coupler, wherein the fourth magnetic axis runs parallel with the first magnetic axis and at an intersecting angle with respect to the second magnetic axis.

6. The ink pad of claim 1, wherein the lid and the base lack a mechanical hinged connection extending between the lid and the base.

7. An ink pad comprising:

a lid comprising a first magnetic coupler that is disposed at a first edge of the lid, a second magnetic coupler that is disposed at a second edge of the lid, a third magnetic coupler, and a fourth magnetic coupler, wherein the first magnetic coupler comprises a first magnetic axis running in a first direction between a north pole and a south pole of the first magnetic coupler, wherein the third magnetic coupler comprises a second magnetic axis running in a second direction between a north pole and a south pole of the third magnetic coupler, and wherein the second magnetic axis runs in a different direction and at an intersecting angle with respect to the first magnetic axis;

a base comprising a fifth magnetic coupler that is disposed at a first edge of the base, a sixth magnetic coupler that is disposed at a second edge of the base, a seventh magnetic coupler, and an eighth magnetic coupler; and an absorbent material comprising an ink, wherein the third and fourth magnetic couplers are configured to magnetically and releasably couple to the seventh and eighth magnetic couplers to magnetically and releasably couple the lid and the base together in a face to face configuration such that the lid and the base form a cavity that houses the absorbent material, and wherein the first and fifth magnetic couplers are configured to magnetically couple with each other to magnetically and releasably couple the lid and the base together in a edge to edge configuration, such that the first edge of the lid and the first edge of the base are abutted against each other.

8. The ink pad of claim 7, wherein the first edge at the perimeter of the lid defines a first elongated partial recess, wherein the first edge at the perimeter of the base defines a second elongated partial recess, and wherein the first elongated partial recess and the second elongated partial recess are configured to form an elongated recess at an exterior perimeter surface of the ink pad when the ink pad is in the face to face configuration.

9. The ink pad of claim 7, wherein the lid and the base are further configured to magnetically and releasably couple with each other in a back to back configuration, and wherein when the lid is magnetically coupled at the first edge to the first edge of the base, the lid is further configured to be magnetically coupled at the second edge of the lid to at least one of another base and another lid.

10. The ink pad of claim 7, wherein the lid comprises a substantially planar first face that extends around and defines the first recess, wherein the lid comprises a first seal component having a seal that extends out from the first face such that the seal is configured to sealingly contact a second seal component of the base when the ink pad is in the face to face configuration.

11. The ink pad of claim 7, wherein the first magnetic axis and the second magnetic axis run substantially perpendicular to each other.

12. The ink pad of claim 7, wherein the lid further comprises a ninth magnetic coupler and a tenth magnetic coupler, wherein the ninth magnetic coupler is disposed adjacent to the first edge of the lid, wherein the tenth magnetic coupler is disposed adjacent to the second edge of the lid, the second edge of the lid being disposed opposite to the first edge of the lid, wherein the ninth magnetic coupler comprises a fifth magnetic axis that runs between a north pole and a south pole of the ninth magnetic coupler, and wherein the fifth magnetic axis runs substantially parallel with the first magnetic axis.

13. The ink pad of claim 12, wherein the third magnetic coupler and the fourth magnetic coupler are each disposed at a different corner of the lid.

14. The ink pad of claim 12, wherein the fourth magnetic coupler comprises a sixth magnetic axis that extends between a north pole and a south pole of the fourth magnetic coupler, wherein the six magnetic axis runs substantially parallel with the second magnetic axis and at an intersecting angle with respect to the first magnetic axis.

15. An ink pad comprising:

a lid comprising a first face defining a first recess, the lid further comprising a first and magnetic coupler that is disposed at a first edge of the lid, a second magnetic coupler that is disposed at a second edge of the lid, a third magnetic coupler, and a fourth magnetic coupler, wherein the second edge of the lid is opposite to the first edge of the lid, wherein the first magnetic coupler comprises a first magnetic axis extending in a first direction between a north pole and a south pole of the first magnetic coupler, wherein the third magnetic coupler comprises a second magnetic axis extending in a second direction between a north pole and a south pole of the third magnetic coupler, and wherein the first magnetic axis and the second magnetic axis run in different directions and at an intersecting angle with respect to each other;

a base comprising a second face defining a second recess, the base further comprising a fifth magnetic coupler that is disposed at a first edge of the base, a sixth magnetic coupler that is disposed at a second edge of the base, a seventh magnetic coupler, and an eighth magnetic coupler, wherein the second edge of the base is opposite to the first edge of the base, wherein the fifth magnetic coupler comprises a third magnetic axis extending in a third direction between a north pole and a south pole of the fifth magnetic coupler, wherein the seventh magnetic coupler comprises a fourth magnetic axis extending in a fourth direction between a north pole and a south pole of the seventh magnetic coupler, and wherein the third magnetic axis and the fourth magnetic axis run in different directions and at an intersecting angle with respect to each other; and an absorbent material comprising an ink, the absorbent material being coupled to, and disposed in at least one of the first recess and the second recess, wherein the third and fourth magnetic couplers of the lid and the seventh and eighth magnetic couplers of the base are configured to magnetically couple together such that the first and second recesses define a cavity that houses the absorbent material, and wherein the first and fifth magnetic couplers are configured to magnetically and releasably couple with each other to magnetically and releasably couple the first edge of the lid with the first edge of the base.

16. The ink pad of claim 15, wherein the lid further comprises a ninth magnetic coupler, wherein the ninth magnetic coupler is disposed at the first edge of the lid, wherein the ninth magnetic coupler comprises a fifth magnetic axis that runs between a north pole and a south pole of the ninth magnetic coupler, wherein the fifth magnetic axis runs substantially parallel with the first magnetic axis, and wherein the third magnetic coupler and the fourth magnetic coupler are each disposed at a different corner of the lid.

17. The ink pad of claim 16, wherein the lid further comprises a tenth magnetic coupler, wherein the tenth magnetic coupler is disposed at the second edge of the lid, wherein the tenth magnetic coupler comprises a sixth magnetic axis that runs between a north pole and a south pole of the tenth magnetic coupler, wherein the sixth magnetic axis runs substantially parallel with the first magnetic axis and at an intersecting angle with respect to the second magnetic axis.

18. The ink pad of claim 15, wherein the lid and the base are configured to magnetically couple with each other in a back to back configuration, and wherein when the lid is magnetically coupled at the first edge to the first edge of the base, the lid is further configured to be magnetically coupled at the second edge of the lid to at least one of another base and another lid.

19. The ink pad of claim 15, wherein the first magnetic axis and the second magnetic axis run substantially perpendicular to each other.

20. The ink pad of claim 15, wherein the lid comprises an interior component and an exterior component that couple together to form the lid.

* * * * *